US010796704B2

(12) United States Patent
Goodwin et al.

(10) Patent No.: US 10,796,704 B2
(45) Date of Patent: Oct. 6, 2020

(54) SPATIAL AUDIO SIGNAL DECODER

(71) Applicant: DTS, Inc., Calabasas, CA (US)

(72) Inventors: Michael M. Goodwin, Scotts Valley, CA (US); Edward Stein, Soquel, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 16/543,083

(22) Filed: Aug. 16, 2019

(65) Prior Publication Data

US 2020/0058311 A1 Feb. 20, 2020

Related U.S. Application Data

(60) Provisional application No. 62/719,400, filed on Aug. 17, 2018.

(51) Int. Cl.
*G10L 19/008* (2013.01)
*H04S 3/02* (2006.01)

(52) U.S. Cl.
CPC ..... *G10L 19/008* (2013.01); *H04S 3/02* (2013.01)

(58) Field of Classification Search
CPC ..... G10L 19/008; H04S 3/02
See application file for complete search history.

(56) References Cited

U.S. PATENT DOCUMENTS 8,712,061 B2 4/2014 Jot et al.
9,240,021 B2 1/2016 Rodriguez
9,271,081 B2 2/2016 Corteel et al.
9,532,158 B2 12/2016 Lando et al.
9,609,452 B2 3/2017 Peters et al.
9,826,328 B2 11/2017 Mehta et al.
9,973,874 B2 5/2018 Edward et al.
2008/0205676 A1 8/2008 Merimaa et al.
(Continued)

FOREIGN PATENT DOCUMENTS

EP 3324406 A1 5/2018
WO WO-2020037280 A1 2/2020
WO WO-2020037282 A1 2/2020

OTHER PUBLICATIONS

U.S. Appl. No. 16/543,343, filed Aug. 16, 2019, Spatial Audio Signal Encoder.

(Continued)

*Primary Examiner* — Yogeshkumar Patel
(74) *Attorney, Agent, or Firm* — Schwegman Lundberg & Woessner, P.A.

(57) ABSTRACT

A method to decode audio signals is provided that includes: receiving an input spatial audio signal; determining directions of arrival of directional audio sources represented in the received input spatial audio signal; determining one of an active input spatial audio signal component and a passive spatial audio signal input component, based upon the determined directions of arrival; determining the other of the active input spatial audio signal component and the passive input spatial audio signal component, based upon the determined one of the active input spatial audio signal component and the passive input spatial audio signal component; decoding the active input spatial audio signal component to a first output format; and decoding the passive input spatial audio signal component to a second output format.

30 Claims, 9 Drawing Sheets

(56) References Cited

U.S. PATENT DOCUMENTS

| | | | | |
|---|---|---|---|---|
| 2008/0232617 | A1* | 9/2008 | Goodwin | H04S 3/008 381/307 |
| 2009/0028347 | A1 | 1/2009 | Duraiswami et al. | |
| 2009/0092259 | A1 | 4/2009 | Jot et al. | |
| 2012/0214515 | A1 | 8/2012 | Davis et al. | |
| 2012/0288114 | A1 | 11/2012 | Duraiswami et al. | |
| 2013/0148812 | A1 | 6/2013 | Corteel et al. | |
| 2013/0208823 | A1* | 8/2013 | Raleigh | H04L 1/0041 375/295 |
| 2014/0350944 | A1 | 11/2014 | Jot et al. | |
| 2015/0011194 | A1 | 1/2015 | Rodriguez | |
| 2015/0208190 | A1 | 7/2015 | Hooks et al. | |
| 2015/0271620 | A1 | 9/2015 | Lando et al. | |
| 2015/0380002 | A1 | 12/2015 | Uhle et al. | |
| 2016/0093311 | A1* | 3/2016 | Kim | H04S 3/008 381/22 |
| 2016/0227337 | A1* | 8/2016 | Goodwin | H04R 1/32 |
| 2016/0227340 | A1 | 8/2016 | Peters | |
| 2017/0366912 | A1 | 12/2017 | Stein et al. | |
| 2017/0366914 | A1 | 12/2017 | Stein et al. | |
| 2018/0020310 | A1 | 1/2018 | Crockett et al. | |
| 2018/0077511 | A1 | 3/2018 | Mehta | |
| 2020/0058310 | A1 | 2/2020 | Goodwin | |

OTHER PUBLICATIONS

"International Application Serial No. PCT/US2019/046936, International Search Report dated Nov. 8, 2019", 2 pgs.
"International Application Serial No. PCT/US2019/046936, Written Opinion dated Nov. 8, 2019", 10 pgs.
"International Application Serial No. PCT/US2019/046938, International Search Report dated Nov. 7, 2019", 2 pgs.
"International Application Serial No. PCT/US2019/046938, Written Opinion dated Nov. 7, 2019", 11 pgs.
Daniel, Jerome, et al., "Further Investigations of High Order Ambisonics and Wavefield Synthesis for Holophonic Sound Imaging", Audio Engineering Society Convention Paper 5788, presented at the AES 114TH Convention, (2003), 18 pgs.
Heller, Aaron, et al., "Is My Decoder Ambisonic?", 25th Convention of the Audio Engineering Society, (2008), 1-27.
Hwang, H K, et al., "Direction of Arrival Estimation using a Root-MUSIC Algorithm", Proceedings of the International MultiConference of Engineers and Computer Scientists, vol. II, (2008), 4 pgs.
Parra, Lucas, "Least Squares Frequency-Invariant Beamforming", IEEE Workshop on Applications of Signal Processing to Audio and Acoustics, (2005), 102-105.
Rife, D., et al., "Transfer-Function Measurement with Maximum-Length Sequences", J. Audio Eng. Soc., 37(6), (1989), 419-444.
Roy, Richard, et al., "ESPRIT-estimation of signal parameters via rotational invariance techniques", IEEE Transactions on Acoustics, Speech, and Signal Processing, 37(7), (1989), 984-995.
Thiergart, O, "Flexible Multi-Microphone Acquisition and Processing of Spatial Sound Using Parametric Sound Field Representations (Ph.D. thesis)", Fredrich-Alexander-Universitat Erlangen-Nurnberg, (2015), 253 pgs.
Politis, Archontis, et al., "COMPASS: Coding and Multidirectional arameterization of Ambisonic Sound Scenes", IEEE, (Apr. 2018), 5 pgs.
Han, Keyong, et al., "Improved Source Number Detection and Direction Estimation With Nested Arrays and ULAs Using Jackkni?ng", EEE Transactions on Signal Processing, vol. 61, No. 23, (2013), 6118-6128.
Schmidt, R. O., "Multiple Emitter Location and Signal Parameter Estimation", IEEE Transactions on Antennas and Propagation, vol. AP-34, No. 3, (1986), 276-280.
Thiergart, Oliver, et al., "Robust 3D Sound Capturing with Planar Microphone Arrays Using Directional Audio Coding (Convention Paper 9866)", Presented at the 143rd Convention for the Audio Engineering Society, (2017), 10 pgs.
Zhao, Shengkui, et al., "3D Binaural Audio Capture and Reproduction Using a Miniature Microphone Array", Proc. of the 15th Int. Conference on Digital Audio Effects (DAFx-12), (2012), 4 pgs.
"International Application Serial No. PCT/US2020/018447, International Search Report dated May 13, 2020", 5 pgs.
"International Application Serial No. PCT/US2020/018447, Written Opinion dated May 13, 2020", 8 pgs.
Nils, Peters, et al., "Scene-based Audio implemented with Higher Order Ambisonics (HOA)", SMPTE 2015 Annual Technical Conference & Exhibition, (Oct. 26, 2015).

* cited by examiner

SPATIAL AUDIO SIGNAL DECODER

CLAIM OF PRIORITY

This patent application claims priority to U.S. Patent Application No. 62/719,400, tiled on Aug. 17, 2018.

BACKGROUND

A spatial audio signal decoder typically performs one or more operations to convert spatial audio signals from an input spatial audio format to an output spatial audio format. Known spatial audio signal format decoding techniques include passive decoding and active decoding. A passive signal decoder carries out decoding operations that are based upon the input spatial audio signal format and the output spatial audio signal format and perhaps external parameters such as frequency, for example, but do not depend upon spatial characteristics of the audio input signal, such as the direction of arrival of audio sources in the audio input signal, for example. Thus, a passive signal decoder performs one or more operations independent of the spatial characteristics of the input signal. An active signal decoder, on the other hand, carries out decoding operations that are based upon the input spatial audio signal format, the output spatial audio signal format and perhaps external parameters such as frequency, for example, as well as spatial characteristics of the audio input signal. An active signal decoder often performs one or more operations that are adapted to the spatial characteristics of the audio input signal.

Active and passive signal decoders often lack universality. Passive signal decoders often blur directional audio sources. For example, passive signal decoders sometimes render a discrete point source in an input audio signal format to all of the channels of an output spatial audio format (corresponding to an audio playback system) instead of to a subset localized to the point-source direction. Active signal decoders, on the other hand, often focus diffuse sources by modeling such sources as directional, for example, as a small number of acoustic plane waves. As a result, an active signal decoder sometimes imparts directionality to nondirectional audio signals. For example, an active signal decoder sometimes renders nondirectional reverberations from a particular direction in an output spatial audio format (corresponding to an audio playback system) such that the spatial characteristics of the reverberation are not preserved by the decoder.

SUMMARY

In one aspect, an audio signal decoder is provided that includes a processor and a non-transitory computer readable medium operably coupled thereto, the non-transitory computer readable medium comprising a plurality of instructions stored in association therewith that are accessible to, and executable by, the processor, where the plurality of instructions that include instructions that, when executed, determine a number and direction of arrival of directional audio sources represented in one or more input spatial audio signals having an input spatial format. Instructions are included that, when executed, determine one of an active input spatial audio signal component and a passive spatial audio signal input component, based upon the determined number and direction of arrival of the audio sources represented in the one or more input spatial audio signals. Instructions are included that, when executed, determine the other of the active input spatial audio signal component and the passive input spatial audio signal component, based upon the determined one of the active input spatial audio signal component and the passive input spatial audio signal component. Instructions are included that, when executed, decode the active input spatial audio signal component having the input spatial format, to a first output signal having a first output format. Instructions are included that, when executed, decode the passive input spatial audio signal component having the input spatial format, to a second output signal having a second output format.

In another aspect, a method is provided to decode audio signals. The method includes receiving an input spatial audio signal in an input spatial format. A number and direction of arrival of directional audio sources represented in one or more input spatial audio signals having an input spatial format is determined. One of an active input spatial audio signal component and a passive spatial audio signal input component is determined, based upon the determined number and direction of arrival of the audio sources represented in the one or more input spatial audio signals. The other of the active input spatial audio signal component and the passive input spatial audio signal component is determined, based upon the determined one of the active input spatial audio signal component and the passive input spatial audio signal component. The active input spatial audio signal component having the input spatial format is decoded to provide a first output signal having a first output format. The passive input spatial audio signal component having the input spatial format is decoded to provide a second output signal having a second output format.

BRIEF DESCRIPTION OF DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DESCRIPTION OF EMBODIMENTS

Terminology

The terms spatial encoding, spatial coding, or spatial audio coding refer to representing a sound scene or soundfield in terms of audio signals and side information.

The terms spatial format or spatial audio format or spatial audio signal refer to audio signals and side information that represent a sound scene or soundfield; the side information may entail a definition of the format, such as directional characteristics corresponding to each of the audio channels in the format, and in some cases, may also include signal-dependent information such as the directions of sources present in the audio signals. A spatial audio signal includes one or more constituents that may be referred to as audio signal components, or audio channels. In some examples, a spatial audio signal may be referred to as an audio signal in a spatial format.

The terms spatial decoding or spatial audio decoding refer to processing an input spatial audio signal in a specified spatial audio format to generate an output spatial audio signal in a specified spatial audio format; decoding may correspond to "transcoding" from the input spatial audio format to a different spatial audio format or to generating signals for playback over a specified audio reproduction system, such as a multichannel loudspeaker layout. An audio reproduction system may correspond to a spatial audio format.

Spatial Audio Decoder

Figure 1A:
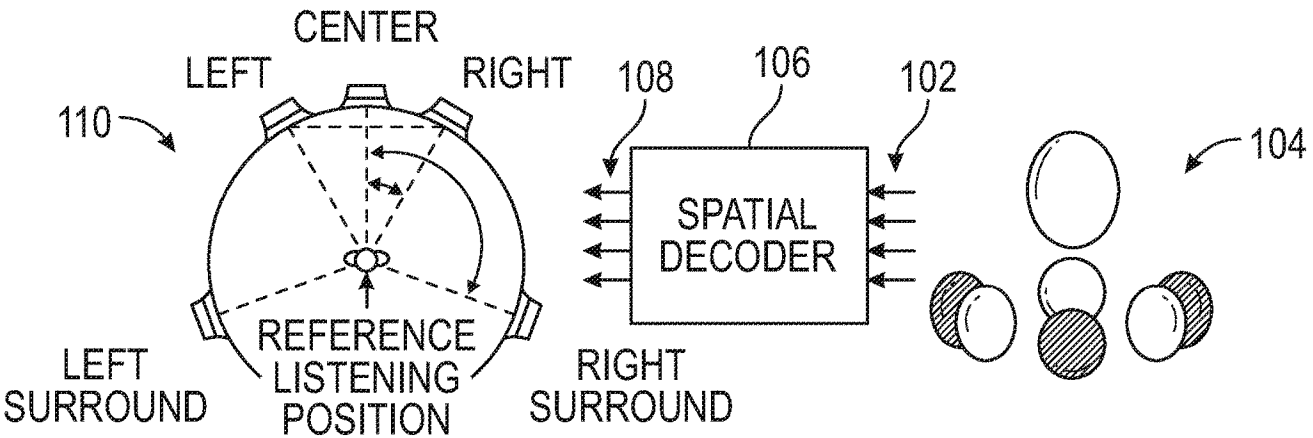
FIG. 1A is an illustrative generalized block diagram representing operation of an example spatial audio signal decoder to decode an input audio signal in an input spatial format to an output audio signal in an output spatial format.

FIG. 1A is an illustrative generalized block diagram representing operation of an example spatial audio signal decoder 106 to decode an input spatial audio signal 102 in an input spatial audio format 104 to an output spatial audio signal 108 in an output spatial audio format suitable for a multichannel audio reproduction system 110. Specifically, the example spatial audio signal decoder 106 transforms an input signal in a first-order ambisonics B-format to an output signal in a multichannel audio format suitable for playback in the multichannel audio reproduction system. A spatial audio decoder 106 implemented as a passive decoder performs the transformation from the input spatial format to the output spatial format independent of spatial characteristics of the audio input signal, such as direction of arrival of the audio input signal, as explained below. A spatial audio decoder 106 implemented as an active decoder performs the transformation from the input spatial format to the output spatial format based at least in part upon spatial characteristics of the audio input signal.

Figure 1B:
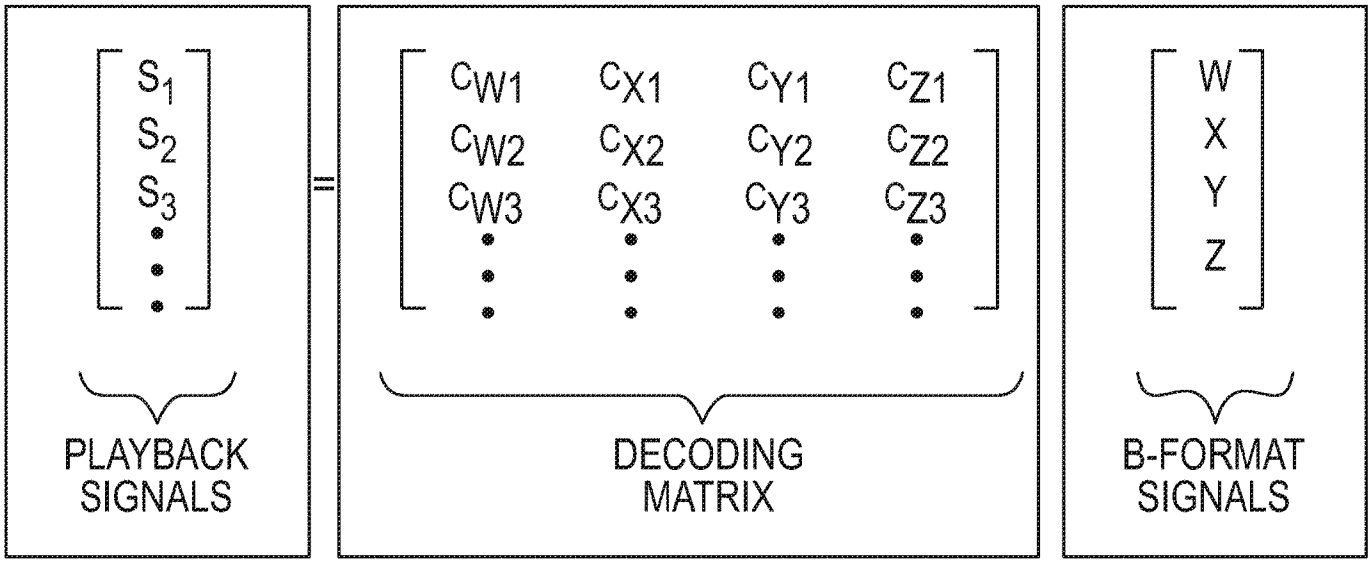
FIG. 1B is an illustrative drawing representing an example configuration of the generalized spatial audio signal decoder of FIG. 1A.

FIG. 1B is an illustrative drawing representing an example configuration of the generalized spatial audio signal decoder of FIG. 1A. The decoder is configured to map an input spatial audio signal in an input spatial format to an output spatial audio signal in an output spatial format. As described more fully below with reference to FIG. 3, one example decoder is configured as an active signal decoder 308, and another example decoder is configured as a passive signal decoder 310. It will be appreciated that each input spatial audio signal includes multiple audio signal components and that each output spatial audio signal includes multiple audio signal components. The respective audio signal components may be referred to as channels. The example decoder includes one or more mapping operations to map M input spatial audio signal components to N spatial audio output signal components. More particularly, an example mapping operation includes an M-by-N spatial decoder matrix to map M input spatial audio signal components in an input spatial format to N spatial audio output signal components in an output spatial format. The mapping operations are used as a basis to configure the decoder as an active signal decoder or a passive signal decoder.

In the example generalized decoder 106, the value of M is four since the input spatial format is the first-order ambisonics B-format, which has four signal components, and the value of N depends, at least in part, upon the number of speakers in the multichannel audio reproduction system. The spatial format of the input spatial audio signal received by the example signal decoder consists of audio input signal components W, X, Y, L with directivity patterns given by the respective elements in the vector $\vec{d}(\Omega)$ defined as $$\vec{d}(\Omega) = \begin{bmatrix} \frac{1}{\sqrt{2}} \\ \cos\theta\cos\phi \\ \sin\theta\cos\phi \\ \sin\phi \end{bmatrix} \tag{1}$$

where Ω corresponds to an angular pair consisting of an azimuth angle θ and an elevation angle ϕ with respect to a reference point for measurement. A spatial audio scene or soundfield is encoded in the W, X, Y, and Z components in accordance with the directivity patterns defined in the above vector $\vec{d}(\Omega)$. For instance, a point source S at azimuth angle θ and elevation angle ϕ is encoded in the B-format components as $$\begin{bmatrix} W \\ X \\ Y \\ Z \end{bmatrix} = \begin{bmatrix} \frac{1}{\sqrt{2}} \\ \cos\theta\cos\phi \\ \sin\theta\cos\phi \\ \sin\phi \end{bmatrix} S. \tag{2}$$

Ambisonics is a technique to represent a soundfield by capturing/encoding a fixed set of signals corresponding to a single point in the soundfield. Each of the fixed set of signals in an ambisonic representation has a defined directivity pattern. The directivity patterns are designed such that ambisonic-encoded signals carry directional information for all of the sounds in an entire soundfield. An ambisonic encoder (not shown) encodes a soundfield in an ambisonic format. An ambisonic format is independent from the specific loudspeaker layout which may be used to reconstruct the encoded soundfield. An ambisonic decoder decodes ambisonic format signals for a specific loudspeaker layout. Eric Benjamin, Richard Lee, and Aaron Heller, Is My Decoder Ambisonic?, 125th AES Convention, San Francisco 2008, provides a general explanation of ambisonics.

In some examples, the signal decoder transforms an input audio signal in an input spatial format to an output audio signal in an output spatial format suitable for a five-loudspeaker layout as depicted in FIG. 1A. As will be understood by those of ordinary skill in the art, the examples are not limited to the multichannel loudspeaker layout depicted in FIG. 1A. Example signal decoders can be configured to decode to a 5.1 loudspeaker layout, a 7.1 loudspeaker layout, an 11.1 loudspeaker layout, or some other loudspeaker layout, for example. In another example (not shown), the signal decoder transforms an input audio signal in an input spatial format to an output audio signal in a two-channel binaural format. Moreover, as will be understood by those of ordinary skill in the art, the examples are not limited to input audio signals in the first-order ambisonics B-format. In another example (not shown), the signal decoder transforms an input audio signal in a higher-order ambisonics format to an output audio signal in an output spatial format.

A First Multiple Spatial Audio Decoder System

Figure 2:
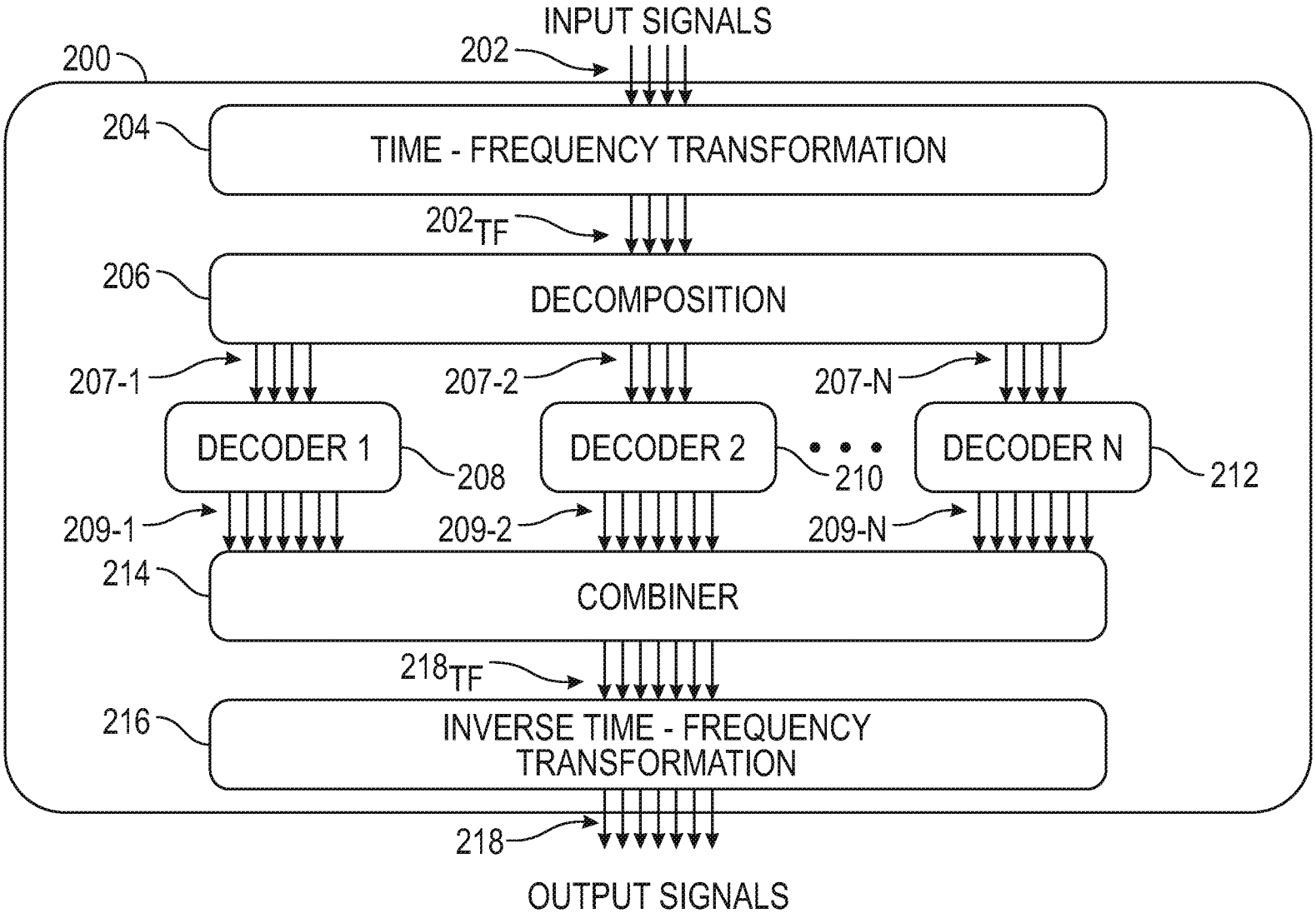
FIG. 2 is an illustrative schematic block diagram of an example first multiple spatial audio signal decoder system.

FIG. 2 is a schematic block diagram of an example first multiple spatial audio signal decoder system 200. The first multiple spatial audio signal decoder system 200 includes a computer system that includes one or more processor devices configured operatively coupled to one or more non-transitory storage devices that store instructions to configure the processing devices to provide the processing blocks described with reference to FIG. 2. More particularly, the first example spatial audio signal decoder system 200 includes a time-frequency transformation block 204, an input signal decomposition block 206, multiple spatial audio signal decoder blocks 208-1 to 208-N, a combiner block 214 and an inverse time-frequency transformation block 216. The time-frequency transformation block 204 receives a time-domain input spatial audio signal 202 in an input spatial audio format and converts the input spatial audio signals to a time-frequency representation $\mathbf{202}_{TF}$. Subsequent processing is carried out in a corresponding time-frequency domain. An alternative example first spatial audio signal decoder system (not shown) omits the time-frequency transformation block so that subsequent processing is carried out in the time domain. The input signal decomposition block 206 decomposes the input spatial audio signal $\mathbf{202}_{TF}$ to produce multiple constituent decoder input spatial audio signals 207-1, 207-2, to 207-N that add up to the time-frequency input spatial audio signal $\mathbf{202}_{TF}$. It will be understood that each of the decoder input spatial audio signals 207-1, 207-2, to 207-N includes multiple component signals. Each of the decoder input spatial audio signals 207-1, 207-2, to 207-N is provided to a respective decoder 208, 210, to 212. In an example of the first decoder system 200, the multiple decoder input spatial audio signals 207-1, 207-2, to 207-N, in the time-frequency domain, have the same spatial format as the input spatial audio signal $\mathbf{202}_{TF}$, in the time domain. Each of the spatial audio signal decoder blocks 208 to 212 transforms a decoder input spatial audio signal having a respective input spatial audio format to a respective decoder output spatial audio signal having a respective output spatial audio format. More particularly, for example, decoder block 208 converts decoder input spatial audio signal 207-1 having a respective input spatial format to decoder output spatial audio signal 209-1 having a respective output spatial format. Decoder block 210 converts decoder input spatial audio signal 207-2 having a respective input spatial format to decoder output spatial audio signal 209-2 having a respective output spatial format. Decoder block 212 converts decoder input spatial audio signal 207-N having a respective input spatial format to decoder output spatial audio signal 212-N having a respective output spatial format.

In the example first decoder system 200, each respective decoder block 208 to 212 transforms a respective decoder input spatial audio signals 207-1 to 207-N having a corresponding input spatial format to respective decoder output spatial audio signals 209-1 to 209-N having a common output spatial format such as a common multichannel loudspeaker layout. In another example decoder (not shown), different respective ones of the decoder blocks 208 to 212 transform respective decoder input audio signals 207-1 to 207-N to respective decoder output audio signals 209-1 to 209-N having different spatial formats. For instance, in an example first decoder system 200, decoder block 208 is configured to transform input audio signal 207-1 from an input spatial audio format to a corresponding decoder output audio signal 209-1 having a spatial format suitable for a multichannel loudspeaker layout; decoder block 210 is configured to transform input audio signal 207-2 from an input spatial audio format to a corresponding decoder output audio signal 209-2 having an output spatial format suitable for binaural reproduction over headphones; and decoder block 212 is configured to decode to a spatial audio format corresponding to a subset of the multichannel loudspeaker layout used by 208.

The combiner block 214 includes a summation circuit to sum the respective output spatial audio signals 209-1 to 209-N to produce decoder output signals $\mathbf{218}_{TF}$ (in a time-frequency representation). In an example first decoder system 200, an output of the combiner 214 is a summation of the output audio signals 209-1 to 209-N. In another example decoder system (not shown), the combiner 214 performs additional processing such as filtering or decorrelation. Inverse time-frequency transformation block 216 converts the combined decoder output signal $\mathbf{218}_{TF}$ (in the time-frequency domain) to a time-domain output spatial audio signal 218 for provision to a sound reproduction system.

It will be appreciated that since the system 200 decodes to output formats where one is a subset of another, the combiner 214 combines the shared channels and a common inverse time-frequency transformation 216 is used to generate output signals 218. In an alternative embodiment (not shown) in which decoders decode to different output formats, a separate inverse T-F transform block is provided for each decoder and no combiner is included.

A Second Multiple Spatial Audio Decoder System

Figure 3:
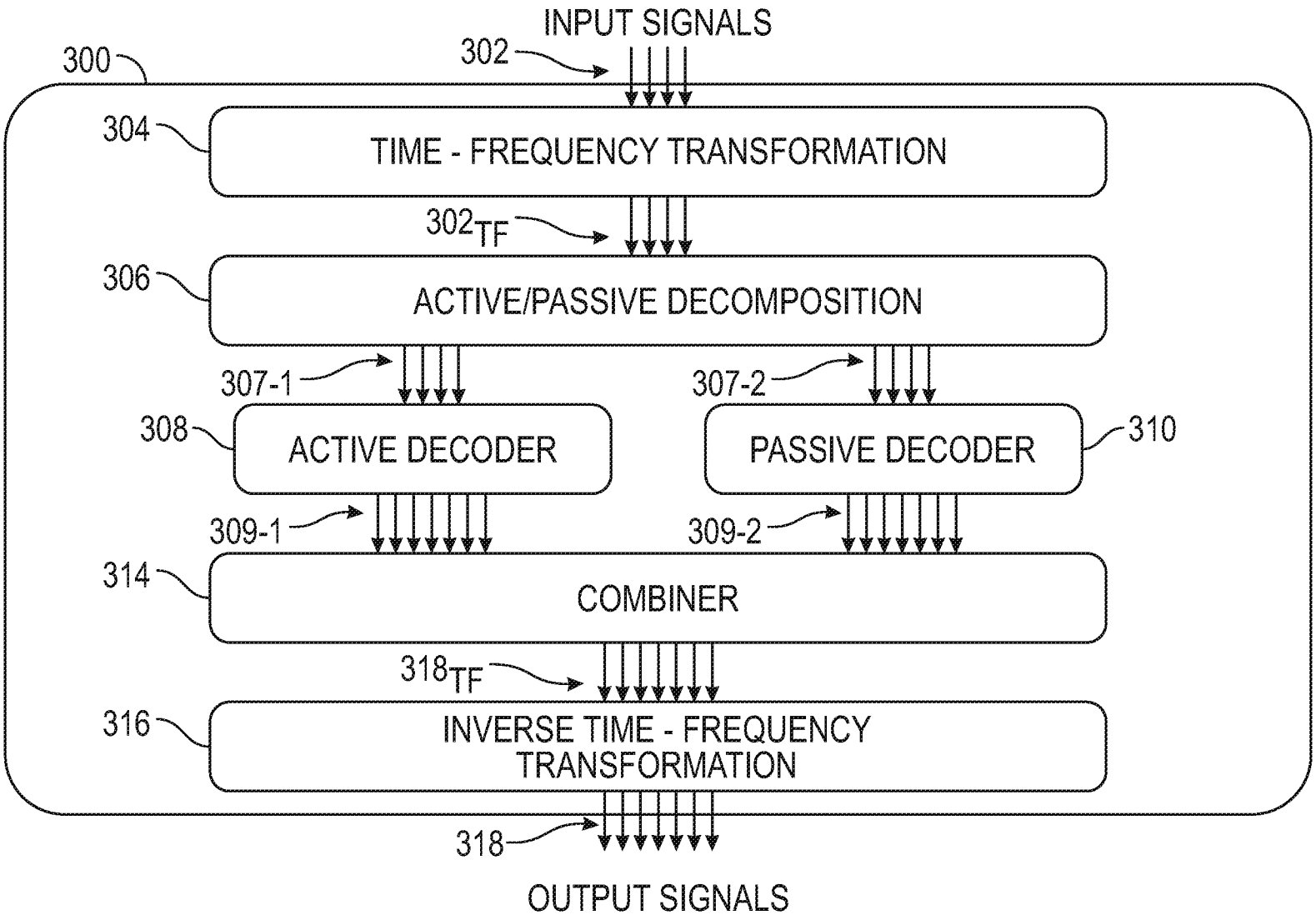
FIG. 3 is an illustrative schematic block diagram of an example second multiple spatial audio signal decoder system.

FIG. 3 is a schematic block diagram of an example second multiple spatial audio signal decoder system 300. The second multiple spatial audio signal decoder system 300 includes a computer system that includes one or more processor devices configured operatively coupled to one or more non-transitory storage devices that store instructions to configure the processing devices to provide the processing blocks described with reference to FIGS. 3-4. More particularly, the second example spatial audio signal decoder system 300 includes a time-frequency transformation block 304, an input signal active/passive signal decomposition block 306, an active spatial audio signal decoder block 308, a passive spatial audio signal decoder block 310, a combiner block 314 and an inverse time-frequency transformation block 316. To avoid complicating the description, explanations of constituent blocks of the example second decoder system 300 that are identical to or substantially identical to corresponding blocks of the example first decoder system 200 are not repeated in the following description. The active/passive input signal decomposition block 306 decomposes input signal $302_{TF}$, in the time-frequency domain, to produce active input spatial audio signal component 307-1, and a passive input spatial audio signal component 307-2. The active and passive decoder input spatial audio signals 307-1 and 307-2 add up to the time-frequency input spatial audio signal $302_{TF}$. It will be understood that each of the decoder input spatial audio signals 307-1 and 307-2 includes multiple component signals. In an example second decoder system 300, the active and passive input spatial audio signal components 307-1, 307-2, in the time-frequency domain, are in the same spatial audio format as the received input audio signal 302, which is received in the time domain.

The active signal decoder block 308 receives the active input spatial audio signal component 307-1. It will be appreciated that the active decoder output format is part of the configuration of the active decoder. A feature of ambisonics and other spatial audio encoding methods is to be agnostic to the output format, meaning the input spatial audio signal can be decoded to whatever format the decoder is configured to provide output signals for. The active signal decoder block 308 transforms the active input spatial audio signal component 307-1 having a respective input spatial format, to an active spatial audio output signal component 309-1 having the active signal output spatial format. The passive block 310 receives the passive input spatial audio signal component 307-2. It will be appreciated that the passive decoder output format is part of the configuration of the passive decoder. The passive signal decoder block 310 transforms the passive input spatial audio signal component 307-2 having a respective input spatial format, to a passive spatial audio output signal component 309-2 having the specified passive signal output spatial format. Moreover, in the example second decoder system 300, the passive signal decoder block 310 may partition the passive input spatial audio signal component 307-2 into one or more frequency bands such that different processing may be applied to each frequency band. For instance, an example passive signal decoder block 310 is configured to perform a lower frequency range transformation operation for a frequency range of the passive input spatial audio signal component 307-2 below a cutoff frequency and is configured to perform an upper frequency range transformation operation for a frequency range of the passive input spatial audio signal component 307-2 above the cutoff frequency.

The combiner block 314 combines the active output signal component 309-1 and the passive output signal component 309-2. An example combiner block 314 performs additional processing such as all pass filtering of the passive output signal component 307-2. Different all pass filters may be applied to one or more channels of the passive output signal component to decorrelate the channels prior to the combination with the active signal component. Decorrelation of the channels leads to a more diffuse and less directional rendering, which is generally what is preferable for the passive decoder 310. In an example second decoder system 300, additional processing of the decoded signal components is carried out before combining the decoded signal components; for instance, different filters may be applied to the active and passive components. In another example of the second decoder 300, additional processing of the decoded signal components is carried out after combining the decoded signal components; for instance, a filter may be applied for equalization. The inverse time-frequency transformation block 316 converts combined decoder output signals $318_{TF}$ (in time-frequency domain) to time-domain output spatial audio signals for provision to a sound reproduction system which correspond to the output spatial audio format.

In the second example decoder system 300, the active signal decoder block 308 and the passive signal decoder block 310 are configured to decode to different spatial audio formats. In particular, for example, the active signal decoder block 308 is configured to decode to a binaural format for headphone playback while the passive signal decoder block 310 is configured to decode to a multichannel loudspeaker layout, or vice versa. In another example second decoder system 300, the active signal decoder block 308 and the passive signal decoder block 310 are configured to decode to different multichannel loudspeaker layouts, each of which is a subset or the entirety of an available multichannel loudspeaker layout. In these alternate examples of the second example decoder system 300, the final signal format at the output of the second decoder system 300 is a union or other combination of the output formats of the active and passive signal decoder logic blocks 308, 310.

Figure 4:
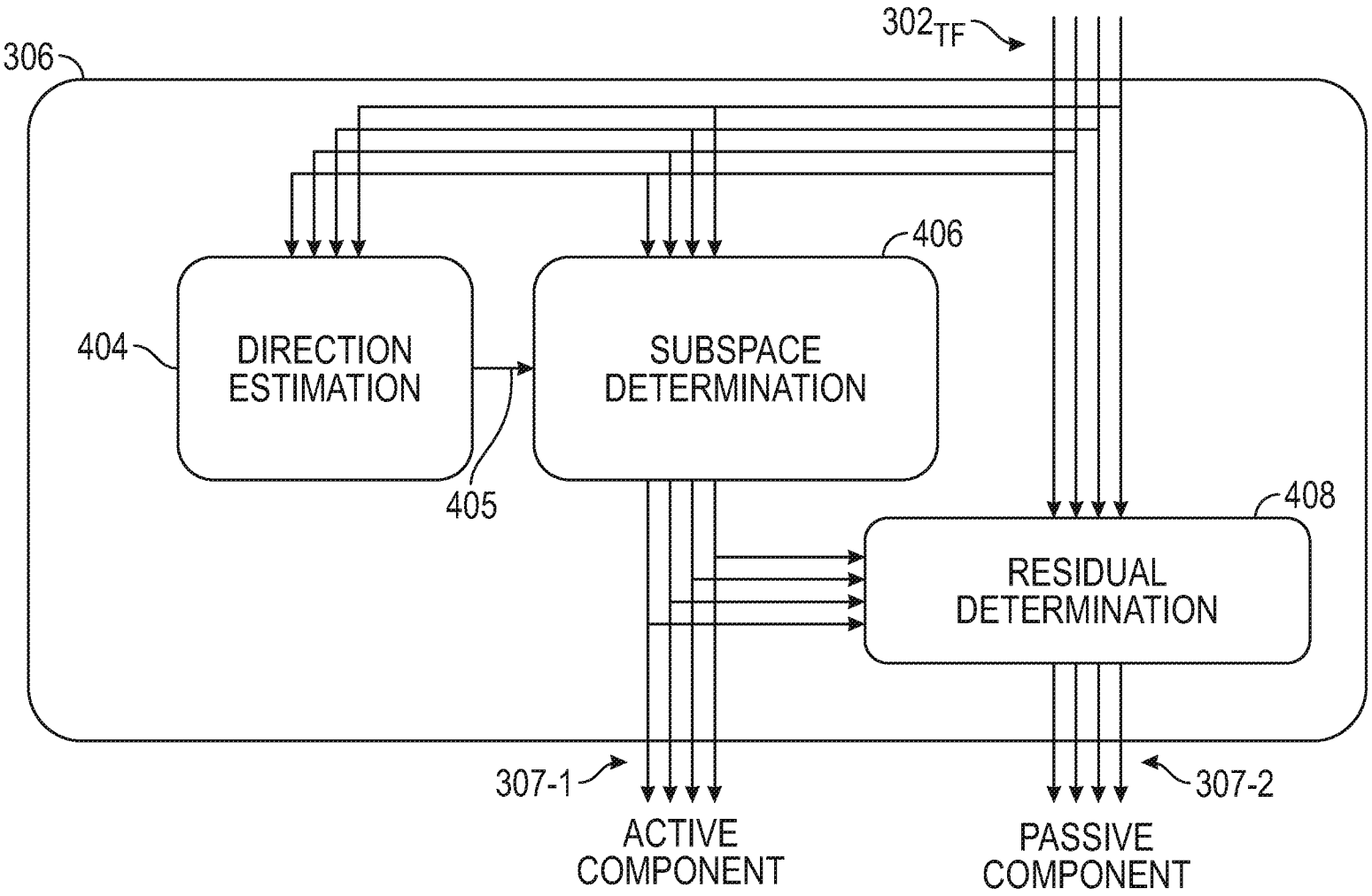
FIG. 4 is an illustrative block diagram of the example active/passive decomposition block of FIG. 3.

FIG. 4 is an illustrative block diagram of the example active/passive decomposition block 306 of FIG. 3. The time-frequency input signal $302_{TF}$ received at the decomposition block 306 is routed to a direction block 404, to a subspace determination block 406 and to a residual determination block 408. The direction block 404 provides an estimate 405 of the number and direction of arrival (DOA) of directional audio sources in the input signal $302_{TF}$ in accordance with an input spatial audio format. The subspace determination block 406 determines the active input spatial audio signal component 307-1 based upon the estimate 405 of the number and DOAs of directional sound sources and the received input signal $302_{TF}$. An example subspace determination block 406 determines the active input spatial audio signal component 307-1 by projecting the active signal component onto a subspace determined based upon the number and DOAs of directional sound sources and the input signal $302_{TF}$. The residual determination block 408 determines the passive input spatial audio signal component 307-2 based upon a difference between the received input signal $302_{TF}$ and the active input spatial audio signal component 307-1 determined by the subspace determination block 406. In an alternative example decomposition block (not shown), the passive input spatial audio signal component is determined first, and the active input spatial audio signal component is determined thereafter based upon a difference between the received input signal $302_{TF}$ and the passive input spatial audio signal component.

Figure 5:
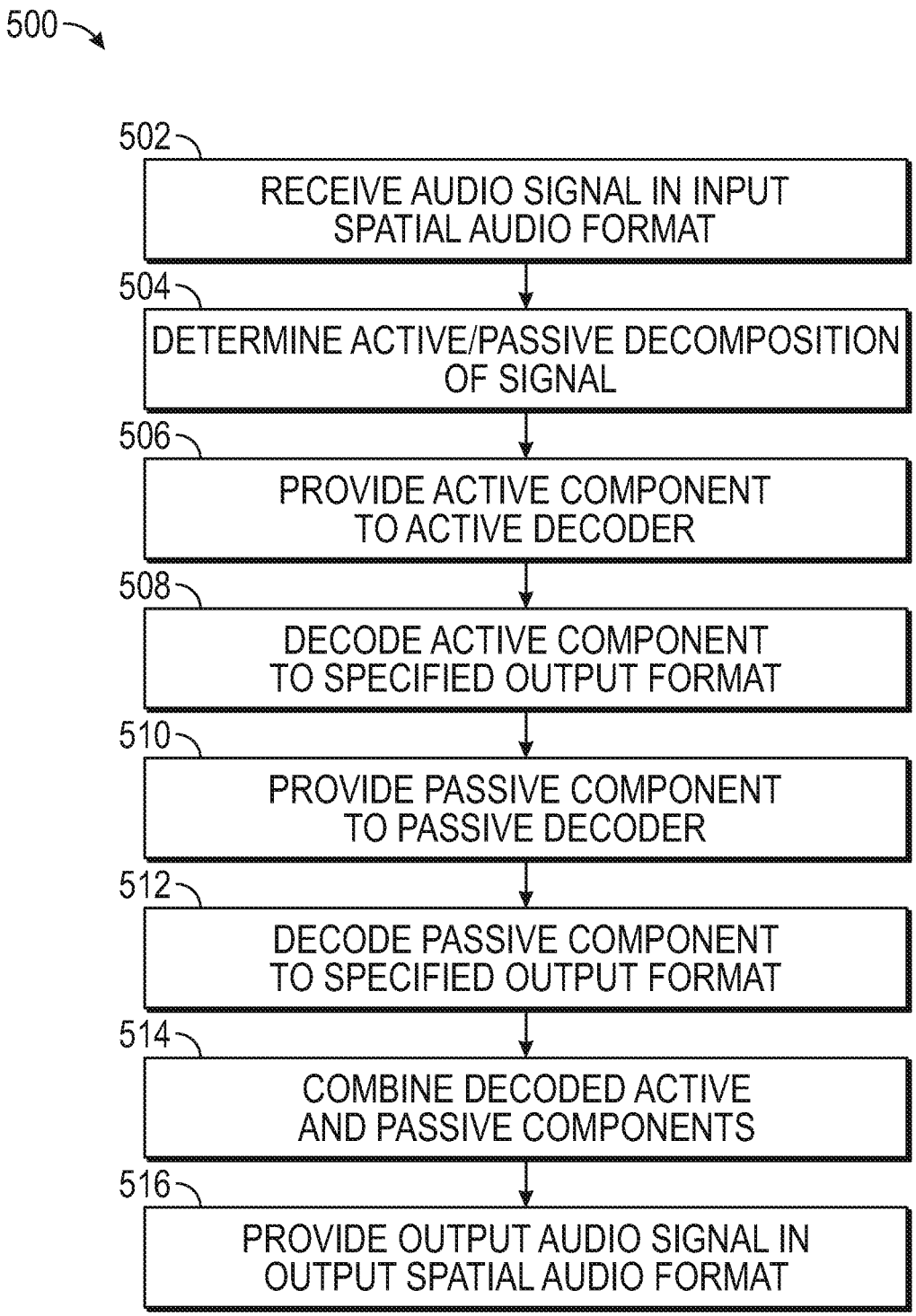
FIG. 5 is an illustrative flow diagram representing an example spatial audio format decoding process.

FIG. 5 is an illustrative flow diagram representing an example spatial audio format decoding process 500. A computer system that includes one or more processor devices configured operatively coupled to one or more non-transitory storage devices store instructions to configure the processing devices to control the blocks of the examples described with reference to FIGS. 1-4 to perform the example spatial audio format decoding process 500. The modules of FIG. 5 correspond to control logic of the one or more processor devices configured according to the instructions. In module 502, an audio signal in a specified spatial audio format is received as input. In some examples, module 502 further comprises transforming the input audio signals into a time-frequency representation, for example using a short-time Fourier transform, which often includes a windowing process. In module 504, the audio input is decomposed into active and passive signal components, for example in accordance with the blocks explained with reference to FIG. 4, In module 506, the active signal component is provided as input to an active signal decoder. In module 508, the active signal decoder decodes the active signal component to a specified output format. In module 510, the passive signal component is provided as input to a passive signal decoder. In module 512, the passive signal decoder decodes the passive signal component to a specified output format. The decoded active signal component and decoded passive signal components are combined in module 514; in some examples, processing such as all-pass filtering is carried out in addition to combining. In module 516, the combined active and passive signal decoder outputs are provided as outputs of the decoder system. The output of the decoder system is provided as audio signals in the output spatial audio format. It will be understood that a spatial audio signal typically includes multiple component audio signals. In some examples, module 516 further comprises transforming the output audio signals from a time-frequency representation to a time-domain signals, for instance using an inverse short-time Fourier transform, which may include windowing and overlap-add processing.

Various examples have been discussed with respect to FIGS. 1-5. In some examples, a decoder system is configured to receive a first-order ambisonics (FOA) signal referred to as a B-format signal. In other examples, a decoder system is configured to receive a higher-order ambisonics (HOA) signal, a multichannel surround signal (such as 5.1, 7.1, or 11.1), or a signal in an arbitrary spatial audio format. In some examples, a decoder system is configured to provide outputs in a multichannel surround spatial audio format. In other examples, a decoder 106 is configured to provide as its output a binaural signal, a first-order ambisonics (FOA) signal, a higher-order ambisonics (HOA) signal, a signal in an arbitrary spatial audio format, or any combination thereof. In some examples, a decoder is configured to receive an FOA signal as input and then provide an HOA signal as output; such examples may be referred to as ambisonic upconverters.

Frequency Band Grouping and Scaling for Spatial Decoding

In some example ambisonic decoder systems, the frequency bins of a short-term Fourier transform (STFT) are grouped into frequency bands. A spatial analysis is carried out for each band rather than for each bin. This reduces the computational complexity of the spatial decoder system and also facilitates smoothing for the direction estimation process. In order to group the STFT bins, the frequency range are partitioned into bands. There are different approaches to partitioning the frequency range into bands. One example approach involves the following parameters:

1. Low frequency cutoff
2. High frequency cutoff
3. Total number of frequency bands Given these parameters, an example band partition is determined as follows. All bins below the low frequency cutoff are grouped into a single band. All bins above the high frequency cutoff are grouped into a single band. Between the low and high frequency cutoff, the band edges are distributed logarithmically so as to form a requisite total number of bands (where the low and high bands already formed by the cutoff frequencies are included in the count). Logarithmic spacing is chosen since this is a good mathematical approximation of psychoacoustic models of the frequency resolution of the human auditory system.

Table 1 sets forth example pseudo-code for deriving a frequency-band partition based on the three parameters outlined as well as the sampling frequency. Given these parameters, a scale factor can be derived for the logarithmically spaced bands to relate the upper edge of a band to its lower edge. For instance, an upper band edge $f_i$ for the i-th band could be computed using $$f_i = \alpha f_{i-1} \tag{3}$$

where $f_{i-1}$ is the upper band edge of the adjacent lower frequency band and $\alpha$ is a scale factor. Given a lowest frequency band edge $f_0$, a highest frequency band edge $f_1$, and a target number of frequency bands B, the scale factor can be derived according to $$\alpha = \left(\frac{f_1}{f_0}\right)^{\frac{1}{B}} \tag{4}$$

This scale factor is used in the pseudo-code to construct a partition band by band consisting of B logarithmically spaced bands between frequencies $f_0$ and $f_1$. In some cases, additional frequency bands may be appended to the frequency partition outside of this frequency range, for instance a low frequency band below frequency $f_0$ and a high frequency band above frequency $f_1$ as in the pseudocode in Table 1.

TABLE 1

```
f0 = 200;          % low cutoff frequency
f1 = 10000;        % high cutoff frequency
Fq = 24000;        % Nyquist frequency
num_bands = 16;                          % total number of bands
num_log_bands = num_bands-2;             % number of log-spaced bands
scale_factor = (f1/f0)^(1/num_log_bands); % scale factor
band_freqs = zeros (num_bands+1, 1);
band_freqs (2) = f0;
fi = f0;
for i=1:num_log_bands
    fi = scale_factor*fi;
    band_freqs(i+2) = round(fi);
end
band_freqs(num_bands)     = f1;
band_freqs(num_bands+1)  = Fq;
```

Given the band edge frequencies, the corresponding bins for each frequency band can be derived in a straightforward manner based on the discrete Fourier transform (DFT) size used for the SIFT. For example, the bins for a frequency band between frequencies $f_i$ and $f_{i+1}$ can be determined as those which satisfy $$k_i \le k < k_{i+1} \tag{5}$$

where $$k_i = \text{round}\left(\frac{f_i}{F_S} K\right) \tag{6}$$

$$k_{i+1} = \text{round}\left(\frac{f_{i+1}}{F_S} K\right) \tag{7}$$

with $F_S$ denoting the sampling rate and K denoting the DFT size used for the STFT.

Figure 6A:
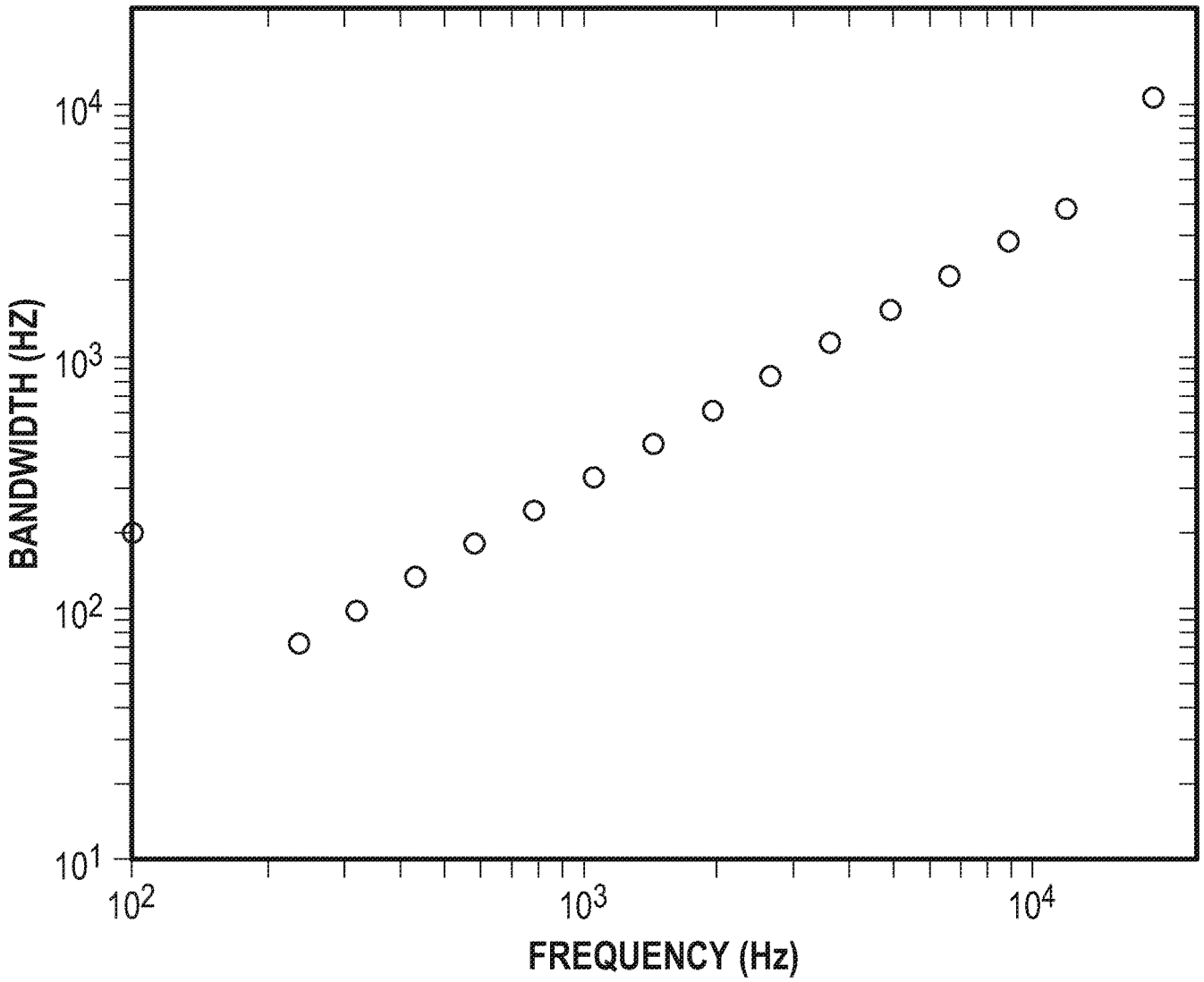
FIG. 6A is an illustrative chart showing the bandwidths of the frequency bands in an example partition as a function of the band center frequencies on a log-log scale.
Figure 6B:
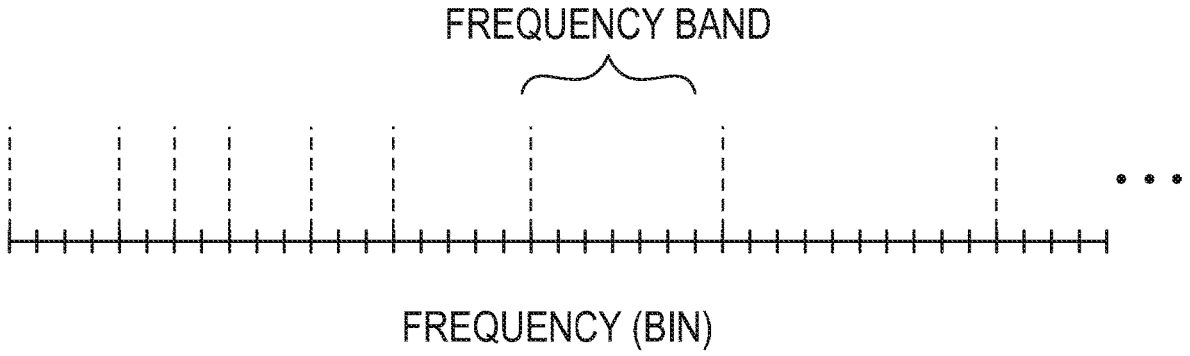
FIG. 6B is an illustrative drawing representing an example use of frequency band edges to group frequency bins into frequency bands.

FIG. 6A is an illustrative chart showing the bandwidths of the frequency bands in an example partition as a function of the band center frequencies on a log-log scale. FIG. 6B is an illustrative drawing representing an example use of frequency band edges to group frequency bins into frequency bands. Referring to FIG. 6B, each of the tick marks on the horizontal line corresponds to a frequency bin. Each of the longer dashed lines corresponds to a frequency bin identified as a frequency band edge for the partition. In the depicted partitioning approach, the frequency bin corresponding to the lower frequency band edge is included in the frequency band whereas the frequency bin corresponding to the higher frequency band edge is excluded from the frequency band; this latter bin will be included as the lower band edge for the adjacent higher-frequency band. This grouping of frequency bins into frequency bands is depicted by the bracket in FIG. 6B.

Active Signal Direction Estimation

The direction block 404 estimates the number and directions of sources in the input spatial audio signal $\mathbf{302}_{TF}$. The source directions, which are typically referred to as directions of arrival (DOAs), may correspond to the angular locations of the sources. The example direction block 404 estimates direction vectors corresponding to the DOAs of audio sources by selecting from a codebook of candidate directions based on the eigenvectors of a spatial correlation matrix in accordance with a multiple signal classification (MUSIC) algorithm for DOA estimation. The eigenvalues of the spatial correlation matrix are used for source counting. See, Schmidt, R. O. "Multiple Emitter Location and Signal Parameter Estimation," IEEE Trans. Antennas Propagation, Vol. AP-34 (March 1986), pp. 276-280 for an explanation of example principles of the MUSIC algorithm. In an example decoder system, the MUSIC algorithm is used to estimate the spatial directions of prominent sources in an input spatial audio signal in the ambisonic format. An example system is configured to receive first-order ambisonics (the B-format). However, the MUSIC algorithm framework is also applicable to higher-order ambisonics as well as other spatial audio formats. The MUSIC algorithm codebook includes direction vectors corresponding to defined locations on a virtual sphere. The direction block 404 estimates a number and directions of audio sources for each of a number of frequency bands within the input signal $\mathbf{302}_{TF}$, based upon eigenvalues and eigenvectors of a spatial correlation matrix and codebook directions associated with the virtual sphere in accordance with the MUSIC algorithm.

An example direction block 404 is configured to perform the MUSIC algorithm as follows.

A set of candidate spatial directions is determined. Each spatial direction is specified as an (azimuth, elevation) angle pair corresponding to a point on a virtual sphere. The set of candidates includes a list of such angle pairs. This list of angle pairs may be denoted as Ω; the i-th element of this list may be denoted as $(\theta_i, \varphi_i)$. In some examples, the set of candidate directions may be constructed to have equal resolution in azimuth and elevation. In some examples, the set of candidate directions may be constructed to have variable azimuth resolution based on the elevation angle. In some examples, the set of candidate directions may be constructed based on the density of the distribution of directions on a unit sphere.

A codebook of direction vectors corresponding to the set of spatial directions Ω is established. In some examples, the codebook entries may be alternatively referred to as steering vectors. For first-order ambisonics, the codebook consists of vectors constructed from the angle pairs in accordance with the directional patterns of the B-format channels. The codebook can be expressed as a matrix where each column is a direction vector (which may be referred to as a steering vector) corresponding to an angle pair $(\theta_i, \varphi_i)$ from the set Ω:

$$D = [\vec{d}_1 \ \vec{d}_2 \ \ldots] \tag{8}$$

$$\vec{d}_i = \begin{bmatrix} \frac{1}{\sqrt{2}} \\ \cos\theta_i \cos\varphi_i \\ \sin\theta_i \cos\varphi_i \\ \sin\varphi_i \end{bmatrix} \tag{9}$$

The spatial correlation matrix of the input signal $\mathbf{302}_{TF}$ is estimated. In an example direction block 404, the estimate is aggregated over one or more frequency bins and one or more time frames. The spatial correlation matrix quantifies the correlation between respective signals in the input spatial format and is defined as $$R_{xx} = E\{\vec{x}\vec{x}^H\} \tag{10}$$

where $\vec{x}$ is a vector of input signals and the superscript H denotes the Hermitian transpose.

In some examples of the direction block 404, the frequency-domain processing framework estimates the spatial correlation matrix for each bin frequency and time frame. In some examples of the direction block 404, the estimate is computed for each one of the frequency bands by aggregating data for the bins within each respective frequency band and further aggregating across time frames. This approach may be formulated as follows:

$$R_{xx}(b, t) = \lambda_b R_{xx}(b, t-1) + (1-\lambda_b)\left(\frac{1}{N_b}\sum_{k \in band\ b} \vec{x}_k \vec{x}_k^H\right) \tag{11}$$

where $N_b$ is the number of frequency bins in band b, where t is a time frame index, and where $x_k$ is a vector of input format signal values for frequency bin k at time t.

An eigendecomposition of the spatial correlation matrix is carried out. The eigenvectors and eigenvalues are portioned into signal and noise components (often referred to as subspaces). In one example, the portioning is done based upon applying a threshold to the eigenvalues, with the larger eigenvalues interpreted as signal components and the smaller eigenvalues interpreted as noise components. In one example, the portioning is done based upon applying a threshold to a logarithm of the eigenvalues, with the larger logarithmic values interpreted as signal components and the smaller logarithmic values interpreted as noise components.

An optimality metric is computed for each element of the codebook. An example optimality metric quantifies how orthogonal the codebook element is to the noise eigenvectors. In an example direction block 404, an optimality metric c[i] is formulated as follows:

$$Q = [\vec{q}_1 \ \vec{q}_2 \ \ldots] \tag{12}$$

$$c[i] = \frac{1}{\|Q^H \vec{d}_i\|} \tag{13}$$

where each vector $\vec{q}$ represents an eigenvector of the spatial correlation matrix corresponding to an eigenvalue portioned as a noise component, in other words an eigenvector corresponding to the noise subspace, and where Q represents a matrix of one or more such noise subspace eigenvectors. Note that the term $Q^H\vec{d}_i$ comprises correlations between the direction vector $\vec{d}_i$ and one or more eigenvectors of the noise subspace. If M is the number of components in the input format and P is the estimated number of sources, then Q may comprise at most M−P such noise subspace eigenvectors. In another example, an optimality metric c[i] is formulated as follows:

$$c[i]=\|Q^H\vec{d}_i\| \tag{14}$$

The extrema in the optimality metric are identified by a search algorithm in accordance with the formulation of the optimality metric. In one example, the extrema identified by the search algorithm may be maxima. In one example, the extrema identified in the search algorithm may be minima. The extrema indicate which codebook elements are most orthogonal to the noise eigenvectors; these correspond to the estimates of the directions of prominent audio sources.

One of the computational costs of a MUSIC-based ambisonics active decoding algorithm is the computation of the optimality metric c [i] for a current input's noise subspace across the entire codebook of possible input source directions for each frequency band. The extrema in this metric reveal the best fit of codes to the input signal, namely, the best direction estimates. For spatial audio applications, where directional accuracy is important, the elements in the codebook must sufficiently represent all possible directions in azimuth and elevation, both above and below the ear level. In some examples, the codebook may be constructed to have a specified azimuth angle resolution for each of a set of elevation angles. In some examples, the codebook may be constructed to have a specified size in accordance with computational constraints. In some examples, the elements in the codebook may be configured with certain symmetries to allow for computational simplifications. In some examples, the elements in the codebook may be configured to have angular resolutions in accordance with psychoacoustic considerations. As will be understood by those of ordinary skill in the art, methods other than the MUSIC-based algorithm can be used for estimating the number and direction of sources in the input spatial audio signal. For instance, an optimality metric can be computed based on the correlation between the input signal vector and the elements of the direction codebook, and the elements with the highest correlation can be selected as the estimated source directions. Such alternative methods are within the scope of the present invention.

Figure 7:
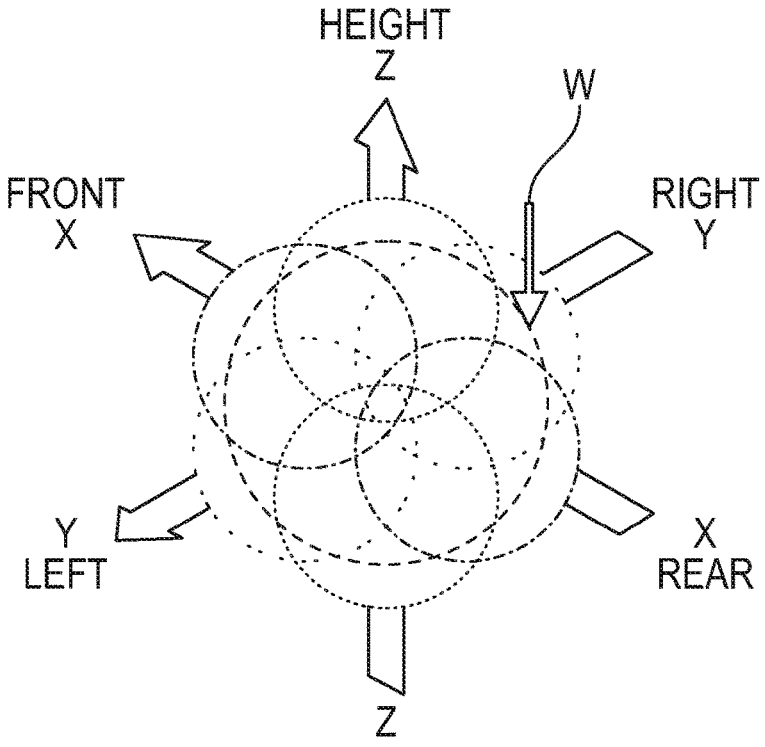
FIG. 7 is an illustrative drawing representing the B-format ambisonic spatial format.

For each combination of azimuth and elevation, a full ambisonic codebook contains the omnidirectional W-channel normalization gain and each of the steering channel gains X (front/back), Y (left/right) and Z (up/down). FIG. 7 is an illustrative drawing representing the B-format ambisonic spatial format. Consider the first-order ambisonic encoding equations, whereby a source S at angle (θ, φ) is encoded into the B-format (in FuMa representation) as follows:

$$W = S\cdot\frac{1}{\sqrt{2}} \tag{15}$$

$$X = S\cdot\cos\theta\cos\phi$$

$$Y = S\cdot\sin\theta\cos\phi$$

-continued $$Z = S\cdot\sin\phi$$

The encoding equations correspond to the directivity patterns of the B-format components. In an example decoder, the codebook of direction vectors is constructed in accordance with the B-format encoding equations. Each vector in the direction codebook corresponds to a candidate angle pair. The elements of a vector in the codebook correspond to the directional gains of the component directivity patterns at the candidate angle pair.

Active Signal Subspace Determination

For each of one or more frequency bands, an example subspace determination block 406 forms an M×P matrix (G) of vectors as, $$G=[\vec{g}_1\ \vec{g}_2\ \ldots\ \vec{g}_P] \tag{16}$$

where each column $\vec{g}_p$ of the matrix G is a vector associated with a source direction and the input spatial audio format, where P is the estimated number of sources, and M is the number of components in the input format. For instance, in an example decoder where the input spatial audio format is the B-format, each column vector of the matrix G may correspond to a direction vector (also referred to as a 'steeling' vector) $\vec{d}(\Omega)$ at a particular angle pair associated with an estimated direction of a source. The matrix G is a matrix of estimated source direction vectors.

For each of one or more frequency bands, the example subspace determination block 406 determines an active subspace projection matrix $\Phi_A=(G^HG)^{-1}G^H$ which represents a subspace projection to map the input signal onto the subspace defined by the identified source directions for the respective frequency band.

For each of one or more frequency hands, the example subspace determination block 406 determines, for each frequency bin in the respective band, an active input spatial audio signal vector $\vec{x}_A$ as $$\vec{x}_A=\Phi_A\vec{x}=(G^HG)^{-1}G^H\vec{x} \tag{17}$$

where $\vec{x}$ is a vector that represents the input spatial audio signal $\mathbf{302}_{TF}$ at a particular time and frequency bin and $\vec{x}_A$ is a vector that represents an active input spatial audio signal component 307-1 at the same time and frequency bin. Thus, direction estimation and various matrices (projection, decoding, etc) are derived per band. They are applied to the signal independently for each bin in the respective band. The subspace determination block 406 provides the active input spatial audio component resulting from the active subspace projection to the active spatial audio signal decoder block 308 and to the residual determination block 408.

Residual Determination

The residual determination block 408 determines the passive input spatial audio signal component 307-2, based upon the determined active input spatial audio signal 307-1. More particularly, for each of one or more frequency bands, an example residual determination block 408 determines, for each frequency bin in the respective band, a passive input spatial audio signal vector $\vec{z}_p$ as a difference (or residual)

between an input signal vector $\vec{x}$ and the active input spatial audio signal vector $\vec{x}_A$, represented as $$\vec{x}_P=\vec{x}-\vec{x}_A. \tag{18}$$

As mentioned above, in an alternative example decomposition block (not shown), the passive input spatial audio signal component is determined first, and the active input spatial audio signal component is determined thereafter. The alternative approach can use the same MUSIC process. More specifically, the passive component $\vec{x}_P$ can be determined first and the active component $\vec{x}_A$ can be determined as the residual after subtracting the passive component from the input. Recalling that $\Phi_A$ denotes the active subspace projection matrix $(G^HG)^{-1}G^H$, some examples may determine the passive component as $\vec{x}_P=(I-\Phi_A)\vec{x}$ and then determine the active component as $\vec{x}_A=\vec{x}-\vec{x}_P$ where I is the M×M identity matrix.

Active Signal Decoder Configuration

The active signal decoder 308 is configured, for each of one or more frequency bands, based upon directions determined by the direction determination block 404 and based upon an active subspace projection matrix determined using the subspace determination block 406.

For each of one or more frequency bands, an example active signal decoder 308 is configured according to an active signal decoder matrix, $$H_A=\Gamma\Phi_A=\Gamma(G^HG)^{-1}G^H \tag{19}$$

where an example N×P matrix $$\Gamma=[\vec{\gamma}_1\ \vec{\gamma}_2 \cdots \vec{\gamma}_P] \tag{20}$$

is formed where each column of the matrix Γ is a direction vector (or steering vector) associated with a determined source direction and the output spatial audio format, and where the superscript H denotes the Hermitian transpose, which for real matrices is the same as the standard transpose. Each column of the matrix Γ is a direction vector or steering vector for the output format corresponding to a source direction identified for the input format. N is the number of components in the output format. It should be noted that the matrix $H_A$ is independent of the order of the P columns in the matrices G and Γ if the ordering is consistent between those two matrices. In some examples, the decoder matrix $H_A$ may be smoothed across time to reduce artifacts. In some examples, the decoder matrix $H_A$ may be smoothed across frequency to reduce artifacts. In some examples, the decoder matrix may be smoothed across time and frequency to reduce artifacts. As an example of smoothing across time, a smoothed decoder matrix $\hat{H}_A(b, t)$ to be used for decoding for frequency band b at time t may be fowled as a combination of the decoder matrix $H_A(b, t)$ specified in Eq. (19) and a smoothed decoder matrix $\hat{H}_A(b, t-1)$ for band b at a preceding time t−1, for instance as $\hat{H}_A(b, t)=\lambda\hat{H}_A(b, t-1)+(1-\lambda)H_A(b, t)$ where λ may be referred to as a smoothing parameter or a forgetting factor.

In operation, an example active signal decoder 308 determines an active output spatial audio signal vector $\vec{y}_A$ representing the active output signal component 309-1 according to the matrix multiplication operation $$\vec{y}=H_A\vec{x}_A \tag{21}$$

which is carried out for each frequency bin in each respective frequency band. In cases where smoothing of the active decoder matrix is incorporated to reduce artifacts, the active output signal component may he determined as $\vec{y}_A=\hat{H}_A\vec{x}_A$. Those of ordinary skill in the art will understand that such a smoothed active decoder matrix may be readily used in the active decoding process instead of the decoder matrix specified in Eq. (19).

Passive Signal Decoder Configuration

The passive signal decoder 310 performs a passive signal spatial transformation that is determined independent of spatial characteristics of the input signal $\mathbf{302}_{TF}$. More particularly, an example passive signal decoder 310 is configured according to a passive signal decoder matrix $H_P$. Each row of the decoder matrix corresponds to an output channel. For example, where the n-th output channel corresponds to a loudspeaker positioned at azimuth angle $\theta_n$ and elevation angle 0, the coefficients of the n-th row of the passive signal decoder matrix can be established as $$[1\ \sin\theta_n\ \cos\theta_n\ 0]. \tag{22}$$

In operation, an example passive signal decoder 310 determines a passive output spatial audio signal vector $\vec{y}_P$ representing the passive output signal component 309-2 according to the following matrix multiplication operation, $$\vec{y}=H_P\vec{x}_P \tag{23}$$

which is carried out for each frequency bin.

in some embodiments, the passive signal decoder 310 may apply a different decoding matrix to different frequency regions of the signal. For instance, the passive signal decoder 310 may apply one decoding matrix for frequencies below a certain frequency cutoff and a different decoding matrix for frequencies above the frequency cutoff As used herein, the term 'passive signal' refers to a signal that is received at the passive decoder. The term 'passive decoder' refers to a decoder that decodes the passive signal without further spatial analysis of the passive signal. FIG. 1B depicts a decoding matrix. Such a decoding matrix is an example of a passive decoder if the coefficients of the matrix are fixed to constant values (as described by "Passive Signal Decoder Configuration" above).

Processing Logic for Active/Passive Decoding

Figure 8:
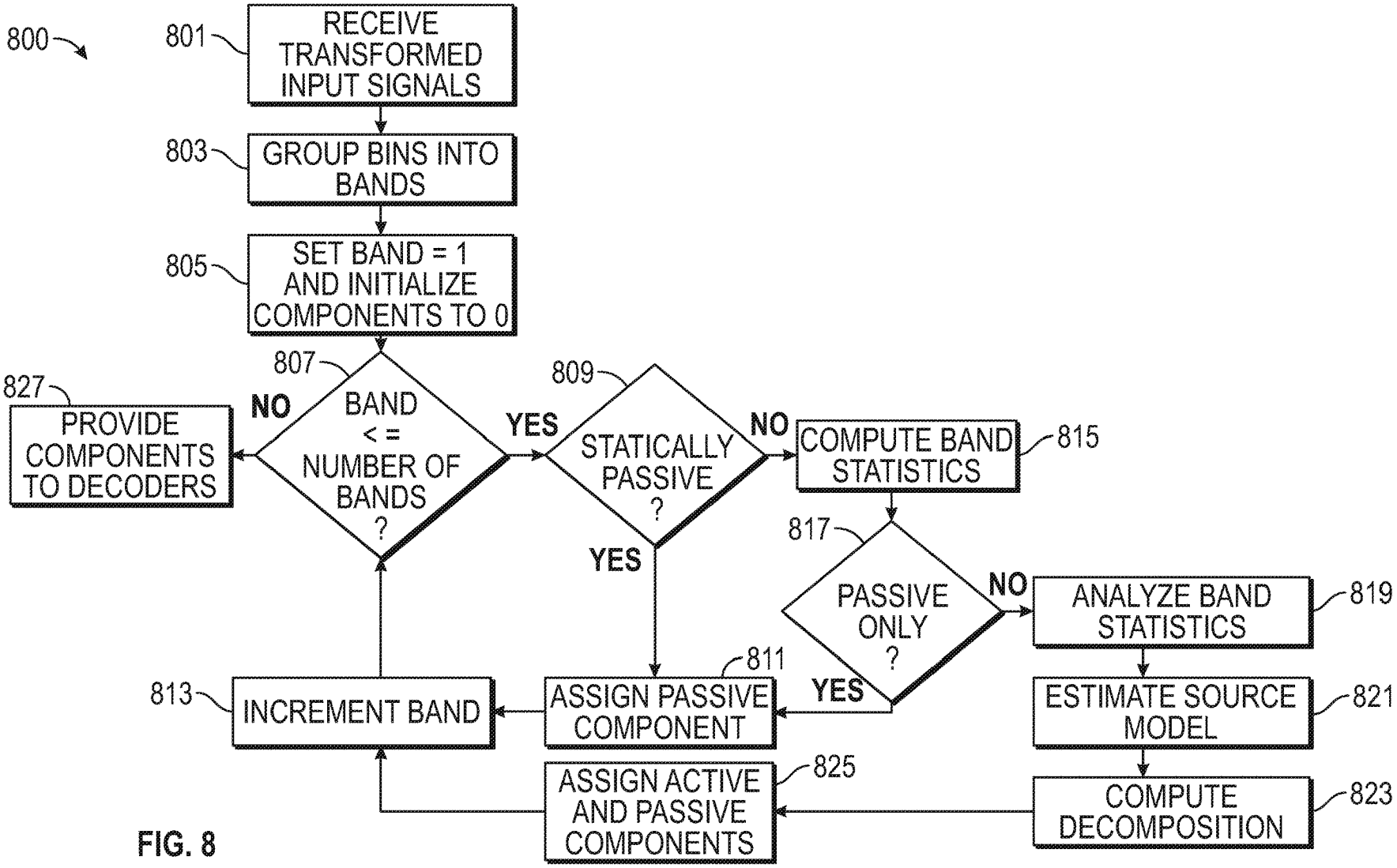
FIG. 8 is an illustrative flow diagram representing a process to selectively control processing of each a number of frequency bands.

FIG. 8 is an illustrative flow diagram representing a process 800 to selectively control processing of each a number of frequency bands. In particular, for example, FIG. 8 shows an example audio content selection processing logic to select audio signal content for process and to select audio signal content to bypass. The selection process 800 controls the flow of processing within modules 404, 406, 408. Moreover, the selection process 800 selectively invokes block 404 to determine whether or not to bypass block 406. A computer system that includes one or more processor devices configured operatively coupled to one or more non-transitory storage devices store instructions to configure the processing devices to control the blocks of the examples described with reference to FIGS. 1-4 to perform the example spatial audio format decoding process 800. The modules of FIG. 8 correspond to control logic of the one or more processor devices configured according to the instructions.

Computational costs associated with a decoding system determining active signal content can be significant. In some operational scenarios, there are frequency bands in which detecting active signal components is less important than in other frequency bands. For instance, it may not be important to detect active signals in a frequency band in which the signal has energy less than a certain threshold. In one example, the threshold may be a fixed energy threshold. In one example, the threshold for a given frequency band may be an adaptive energy threshold based on measurements of the signal energy in other frequency bands. In one example, the threshold for a given frequency band may be an adaptive energy threshold based on measurements of the signal energy in the same frequency band at previous time instants. In one example, the threshold for a given frequency band may be an adaptive energy threshold based on measurements of the signal energy across frequency bands and time. To save computational resources, active signal processing is bypassed for frequency bands of an input signal in which determination of active signal components is less important as explained above, for example. Moreover, in some computational scenarios, energy consumption considerations influence the number of frequency bands processed to detect active signal components. More particularly, in an example decoding system, the number of frequency bands processed to detect active signal components is scaled based upon energy consumption factors (e.g., battery life). For example, computational scalability is used to achieve one or more of (1) statically reducing the computation on a given device, for instance to meet a processing budget constraint, (2) adaptively reducing the computation when other applications need processing power, (3) adaptively reducing the computation to improve battery life.

In module 801, the transformed input signals are received from time-frequency transform block 304. The time-frequency representation of the input signal $\mathbf{302}_{TF}$ corresponds to a time frame and frequency bins spanning the frequency range of the input signal.

In module 803, the frequency bins are grouped into frequency bands in accordance with a partition of the frequency range of the input signal as explained above with reference to FIGS. 6A-6B. As an example, a frequency band in a partition in one example is defined as having a lower frequency bound of 200 Hz and an upper frequency bound of 400 Hz such that the bins whose corresponding frequencies fall within those frequency bounds are grouped into the defined frequency band.

in module 805, a band counter is initialized to one. Furthermore, output buffers for the active and passive signal components of the input signal are initialized to zero.

In module 807, the band counter is compared to the total number of bands in the frequency partition. If the band counter exceeds the total number of bands, the process 800 continues to module 827. If the band counter is less than or equal to the total number of bands, the processing continues to module 809.

In some examples, one or more of the frequency bands in the frequency partition may be designated as statically passive, for example in order to limit the computational cost of the algorithm by not carrying out the full processing for bands where it may not be as perceptually important as for other bands. Moreover, in an example selection process 800, some of the extreme higher or lower frequency bands in the partition are designated to be processed passively at all times. Module 809 checks whether the current frequency band is designated as a statically passive band. If the current band is a statically passive band, then processing continues to module 811. If not, processing continues to module 815. In some examples, block 809 may be omitted such that processing continues directly from module 807 to module 815.

In module 811, the passive signal component for the current band is assigned to be equal to the input signal for the current band. This is used when the determinations in either module 809 or module 817 trigger a bypass of the active/passive decomposition of block 306. From module 811, the process continues to module 813, which increments the band counter. The process 800 then returns to module 807 and repeats based on the incremented counter.

If module 809 determines that the current frequency band is not designated as a statically passive band, processing continues from module 809 to module 815. In module 815, the statistics for the frequency band are computed. Computing the statistics for the frequency band includes configuring direction block 404 to determine the spatial correlation matrix $R_{xx}$ between the input component signals within the current frequency band.

From module 815, the processing continues to module 817, which assesses the statistics of the current frequency band to determine whether the active/passive decomposition should be bypassed for the band. For instance, module 817 may determine that the decomposition calculations should be bypassed if the energy of the band is below a certain threshold, which indicates low information content within the band. This energy threshold may be fixed or adaptive as discussed earlier threshold discussion in this section. Bypassing decomposition computations for a low energy content band can be beneficial for limiting the computational cost of the algorithm. If module 817 determines that the band should be treated as purely passive, processing continues module 811. Otherwise, processing continues to module 819.

In module 819, the statistics of the frequency band are analyzed. Analysis of the statistics of the frequency band includes configuring the direction block 404 to carry out an eigendecomposition of the spatial correlation matrix computed at module 815 for the current frequency band. The eigendecomposition comprises the eigenvectors and corresponding eigenvalues of the spatial correlation matrix.

In module 821, the results of the analysis of the frequency band statistics are used to estimate a source model for the band, for instance a matrix G comprising a number of column vectors wherein the number of column vectors corresponds to an estimated number of sources and where the column vectors correspond to the directions of the respective estimated sources. In some embodiments, this may be carried out using the MUSIC algorithm as explained above. In some embodiments, a source model may include coefficients for the respective sources in the model.

In module 823, the subspace determination block 406 is configured to use the results of the source model estimation to compute an active/passive decomposition for the current frequency band. In some examples, the subspace determination block 406 projects the input signal 302u onto a subspace spanned by the source-model direction vectors in order to determine the active signal component of the current frequency band. The residual determination block 408 is configured to determine a passive signal component of the current frequency band as a residual of the active subspace projection.

In module 825, the active and passive signal components derived at module 823 are assigned to appropriate output buffers. The processing then continues by incrementing the frequency band counter in step 813 and then repeating the process from module 807.

More particularly, in module 825, the active and passive signal components are respectively assigned. In an example decoding system 300, the active and passive signal components are modified by a mixing process, for instance to reduce artifacts. Mathematically, the active-passive decomposition can be expressed as a matrix multiplication to determine one component and a subtraction to determine the other components. For instance, an example active component is derived as a matrix $\Phi_A=(G^HG)^{-1}G^H$ applied to the input signal (the active subspace projection matrix) and the passive component is derived via subtraction as follows. A portion of the passive component can then be added to the active component in a mixing process:

$$\text{Active Component: } \vec{x}_A=\Phi_A\vec{x} \tag{24}$$

$$\text{Passive Component: } \vec{x}_P=\vec{x}-\vec{x}_A=(I-\Phi_A)\vec{x} \tag{25}$$

$$\text{Active Component with Passive Mix: } \vec{x}_A=\vec{x}_A+\in\vec{x}_P \tag{26}$$

$$\text{Passive Component with Passive mix: } \vec{x}_P=(1-\in)\vec{x}_P \tag{27}$$

This can be mathematically reformulated as $$\vec{x}_A=(\in I+(1-\in)\Phi_A)\vec{x} \tag{28}$$

$$\vec{x}_P=\vec{x}-\vec{x}_A. \tag{29}$$

Alternatively, the passive component is derived as a matrix applied to the input signal (where the applied matrix is the identity matrix minus the active subspace projection matrix) and the active component is derived by subtraction as follows. A portion of the active component can then be added to the passive component in a mixing process:

$$\text{Passive Component: } \vec{x}_P=\Phi_P\vec{x} \tag{30}$$

$$\text{Active Component: } \vec{x}_A=\vec{x}-\vec{x}_P=(I-\Phi_P)\vec{x} \tag{31}$$

$$\text{Passive Component with Active Mix: } \vec{x}_P=\vec{x}_P+\in\vec{x}_A \tag{32}$$

$$\text{Active Component with Active Mix: } \vec{x}_A=(1-\in)\vec{x}_A \tag{33}$$

This can be mathematically reformulated as $$\vec{x}_P=(\in I+(1-\in)\Phi_P)\vec{x} \tag{34}$$

$$\vec{x}_A=\vec{x}-\vec{x}_P. \tag{35}$$

In some examples, the mixing process is used to reduce the perceptibility of artifacts. In some examples, the mixing processing is used to redirect certain components to the passive decoder.

Example Hardware Implementation

Figure 9:
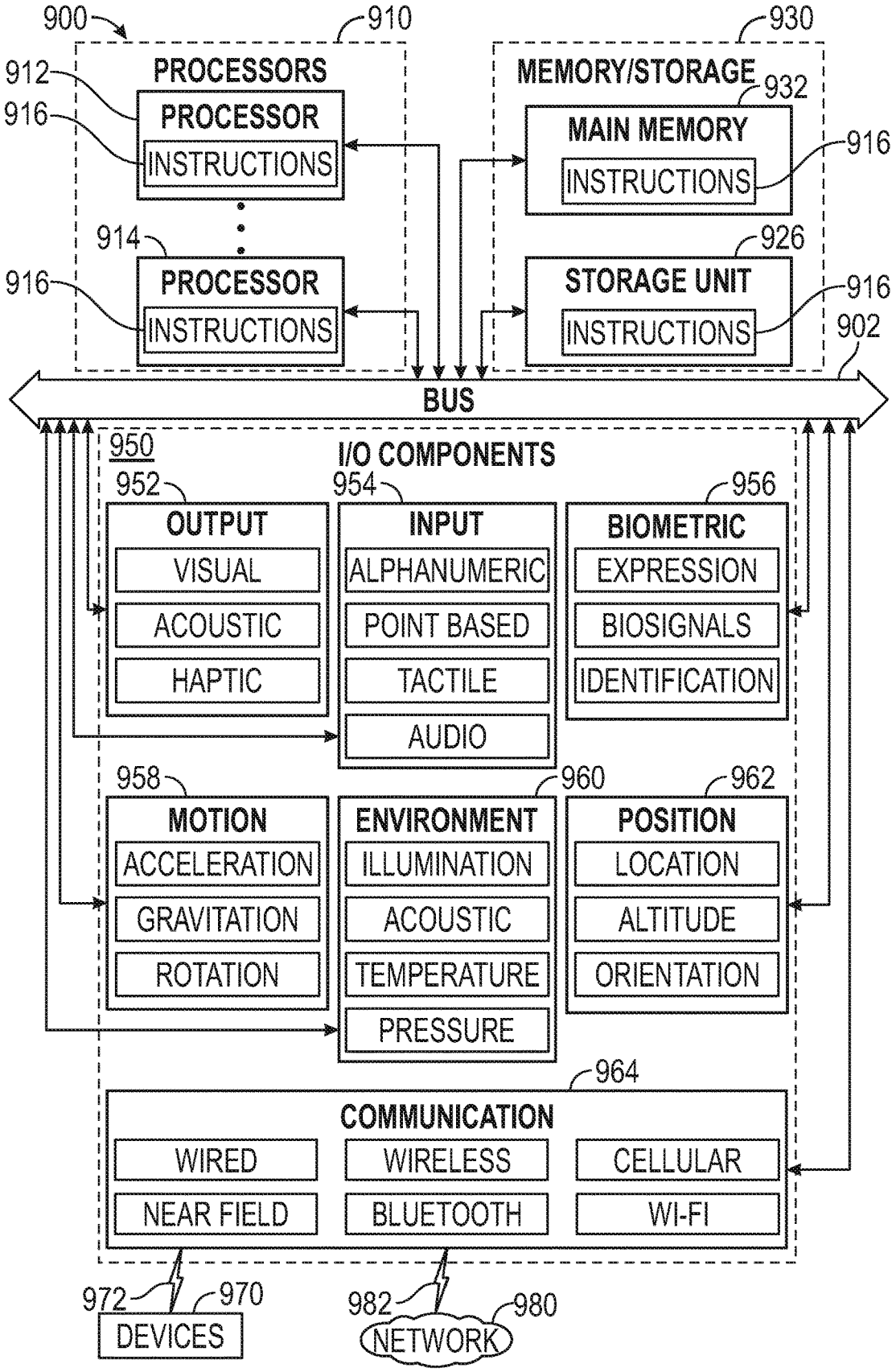
FIG. 9 is an illustrative block diagram illustrating components of a machine, according to some example embodiments, able to read instructions from a machine-readable medium (e.g., a machine-readable storage medium) and perform any one or more of the methodologies discussed herein.

FIG. 9 is an illustrative block diagram illustrating components of a machine 900, according to some example embodiments, able to read instructions 916 from a machine-readable medium (e.g., a machine-readable storage medium) and perform any one or more of the methodologies discussed herein. Specifically, FIG. 9 shows a diagrammatic representation of the machine 900 in the example form of a computer system, within which the instructions 916 (e.g., software, a program, an application, an applet, an app, or other executable code) for causing the machine 900 to perform any one or more of the methodologies discussed herein may be executed. For example, the instructions 916 can configure one or more processor devices 910 to implement the decoder 106 of FIG. 1A, the decoder system 200 of FIG. 2, the decoder system 300 of FIGS. 3-4 and the modules of FIGS. 7-8, for example. The instructions 916 can transform the general, non-programmed machine 900 into a particular machine programmed to carry out the described and illustrated functions in the manner described (e.g., as an audio processor circuit). In alternative embodiments, the machine 900 operates as a standalone device or can be coupled (e.g., networked) to other machines. In a networked deployment, the machine 900 can operate in the capacity of a server machine or a client machine in a server-client network environment, or as a peer machine in a peer-to-peer (or distributed) network environment.

The machine 900 can comprise, but is not limited to, a server computer, a client computer, a personal computer (PC), a tablet computer, a laptop computer, a netbook, a set-top box (STB), a personal digital assistant (PDA), an entertainment media system or system component, a cellular telephone, a smart phone, a mobile device, a wearable device (e.g., a smart watch), a smart home device (e.g., a smart appliance), other smart devices, a web appliance, a network router, a network switch, a network bridge, a headphone driver, or any machine capable of executing the instructions 916, sequentially or otherwise, that specify actions to be taken by the machine 900. Further, while only a single machine 900 is illustrated, the term "machine" shall also be taken to include a collection of machines 900 that individually or jointly execute the instructions 916 to perform any one or more of the methodologies discussed herein.

The machine 900 can include or use processors 910, such as including an audio processor circuit, non-transitory memory/storage 930, and I/O components 950, which can be configured to communicate with each other such as via a bus 902. In an example embodiment, the processors 910 (e.g., a central processing unit (CPU), a reduced instruction set computing (RISC) processor, a complex instruction set computing (CISC) processor, a graphics processing unit (GPU), a digital signal processor (DSP), an ASIC, a radio-frequency integrated circuit (RFIC), another processor, or any suitable combination thereof) can include, for example, a circuit such as a processor 912 and a processor 914 that may execute the instructions 916. The term "processor" is intended to include a multi-core processor 912, 914 that can comprise two or more independent processors 912, 914 (sometimes referred to as "cores") that may execute the instructions 916 contemporaneously. Although FIG. 9 shows multiple processors 910, the machine 900 may include a single processor 912, 914 with a single core, a single processor 912, 914 with multiple cores (e.g., a multi-core processor 912, 914), multiple processors 912, 914 with a single core, multiple processors 912, 914 with multiples cores, or any combination thereof, wherein any one or more of the processors can include a circuit configured to apply a height filter to an audio signal to render a processed or virtualized audio signal.

The memory/storage 930 can include a memory 932, such as a main memory circuit, or other memory storage circuit, and a storage unit 936, both accessible to the processors 910 such as via the bus 902. The storage unit 936 and memory 932 store the instructions 916 embodying any one or more of the methodologies or functions described herein. The instructions 916 may also reside, completely or partially, within the memory 932, within the storage unit 936, within at least one of the processors 910 (e.g., within the cache memory of processor 912, 914), or any suitable combination thereof, during execution thereof by the machine 900.

Accordingly, the memory 932, the storage unit 936, and the memory of the processors 910 are examples of machine-readable media.

As used herein, "machine-readable medium" means a device able to store the instructions 1416 and data temporarily or permanently and may include, but not be limited to, random-access memory (RAM), read-only memory (ROM), buffer memory, flash memory, optical media, magnetic media, cache memory, other types of storage (e.g., erasable programmable read-only memory (EEPROM)), and; or any suitable combination thereof. The term "machine-readable medium" should be taken to include a single medium or multiple media (e.g., a centralized or distributed database, or associated caches and servers) able to store the instructions 916. The term "machine-readable medium" shall also be taken to include any medium, or combination of multiple media, that is capable of storing instructions (e.g., instructions 916) for execution by a machine (e.g., machine 900), such that the instructions 916, when executed by one or more processors of the machine 900 (e.g., processors 910), cause the machine 900 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 950 may include a variety of components to receive input, provide output, produce output, transmit information, exchange information, capture measurements, and so on. The specific I/O components 950 that are included in a particular machine 900 will depend on the type of machine 900. For example, portable machines such as mobile phones will likely include a touch input device or other such input mechanisms, while a headless server machine will likely not include such a touch input device. It will be appreciated that the I/O components 950 may include many other components. The I/O components 950 are grouped by functionality merely for simplifying the following discussion, and the grouping is in no way limiting. In various example embodiments, the I/O components 950 may include output components 952 and input components 954. The output components 952 can include visual components (e.g., a display such as a plasma display panel (PDP), a light emitting diode (LED) display, a liquid crystal display (LCD), a projector, or a cathode ray tube (CRT)), acoustic components (e.g., loudspeakers), haptic components (e.g., a vibratory motor, resistance mechanisms), other signal generators, and so forth. The input components 954 can include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 1450 can include biometric components 956, motion components 958, environmental components 960, or position components 962, among a wide array of other components. For example, the biometric components 956 can include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like, such as can influence a inclusion, use, or selection of a listener-specific or environment-specific impulse response or HRTF, for example. In an example, the biometric components 956 can include one or more sensors configured to sense or provide information about a detected location of the listener in an environment. The motion components 958 can include acceleration sensor components (e.g., accelerometer), gravitation sensor components, rotation sensor components (e.g., gyroscope), and so forth, such as can be used to track changes in the location of the listener. The environmental components 960 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect reverberation decay times, such as for one or more frequencies or frequency bands), proximity sensor or room volume sensing components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 962 can include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication can be implemented using a wide variety of technologies. The I/O components 950 can include communication components 964 operable to couple the machine 900 to a network 980 or devices 970 via a coupling 982 and a coupling 972 respectively. For example, the communication components 964 can include a network interface component or other suitable device to interface with the network 1480. In further examples, the communication components 964 can include wired communication components, wireless communication components, cellular communication components, near field communication (NFC) components, Bluetooth® components (e.g., Bluetooth® Low Energy), Wi-Fi® components, and other communication components to provide communication via other modalities. The devices 970 can be another machine or any of a wide variety of peripheral devices (e.g., a peripheral device coupled via a USB).

Moreover, the communication components 964 can detect identifiers or include components operable to detect identifiers. For example, the communication components 964 can include radio frequency identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF49, Ultra Code, UCC RSS-2D bar code, and other optical codes), or acoustic detection components (e.g., microphones to identify tagged audio signals). In addition, a variety of information can be derived via the communication components 1064, such as location via Internet Protocol (IP) geolocation, location via Wi-Fi® signal triangulation, location via detecting an NFC beacon signal that may indicate a particular location, and so forth. Such identifiers can be used to determine information about one or more of a reference or local impulse response, reference or local environment characteristic, or a listener-specific characteristic.

In various example embodiments, one or more portions of the network 980 can be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the public switched telephone network (PSTN), a plain old telephone service (POTS) network, a cellular telephone network, a wireless network, a Wi-Fi® network, another type of network, or a combination of two or more such networks. For example, the network 980 or a portion of the network 980 can include a wireless or cellular network and the coupling 982 may be a Code Division Multiple Access (CDMA) connection, a Global System for Mobile communications (GSM) connection, or another type of cellular or wireless coupling. In this example, the coupling 1482 can implement any of a variety of types of data transfer technology, such as Single Carrier Radio Transmission Technology (1xRTT), Evolution-Data. Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology. In an example, such a wireless communication protocol or network can be configured to transmit headphone audio signals from a centralized processor or machine to a headphone device in use by a listener.

The instructions 916 can be transmitted or received over the network 980 using a transmission medium via a network interface device (e.g., a network interface component included in the communication components 964) and using any one of a number of well-known transfer protocols (e.g., hypertext transfer protocol (HTTP)). Similarly, the instructions 916 can be transmitted or received using a transmission medium via the coupling 972 (e.g., a peer-to-peer coupling) to the devices 970. The term "transmission medium" shall be taken to include any intangible medium that is capable of storing, encoding, or carrying the instructions 916 for execution by the machine 900, and includes digital or analog communications signals or other intangible media to facilitate communication of such software.

Various Examples Including Articles of Manufacture, Decoders and Methods of Decoding Example 1 can include or use subject matter that includes an article of manufacture including a non-transitory machine-readable storage medium including instructions that, when executed by a machine, cause the machine to perform operations comprising: receiving an input spatial audio signal in an input spatial format; determining (404) a number and directions of arrival of directional audio sources represented in one or more input spatial audio signal having an input spatial format; determining (406) one of an active input spatial audio signal component and a passive spatial audio signal input component, based upon the determined number and directions of arrival of the audio sources represented in the one or more input spatial audio signals; determining (408) the other of the active input spatial audio signal component and the passive input spatial audio signal component, based upon the determined one of the active input spatial audio signal component and the passive input spatial audio signal component; decoding (308) the active input spatial audio signal component having the input spatial format, to a first output signal having a first output format; decoding (310) the passive input spatial audio signal component having the input spatial format, to a second output signal having a second output format.

Example 2 can include the subject matter of Example 1 wherein the first output format is different from the second output format.

Example 3 can include the subject matter of Example 1 wherein the first output format matches the second output format.

Example 4 can include the subject matter of Example 1 wherein determing the number and direction of arrival of directional audio sources includes determining a subspace of a codebook to represent the one or more input spatial audio signals.

Example 5 can include the subject matter of Example 1 wherein determining the number and directions of arrival of directional audio sources includes determining a subspace of a codebook corresponding to one or more direction vectors of the codebook to represent the input spatial audio signals, based upon an optimality metric computed for direction vectors within the codebook.

Example 6 can include the subject matter of Example 5 wherein the optimality metric includes one or more correlations between direction vectors within the codebook and one or more eigenvectors of a noise subspace of the input spatial audio signal.

Example 7 can include the subject matter of Example 5 wherein the optimality metric includes a correlation between direction vectors within the codebook and the input spatial audio signal.

Example 8 can include the subject matter of Example 1 wherein determining a number and directions of arrival of directional audio sources, includes determining a subspace of a codebook corresponding to one or more direction vectors of the codebook to represent the input spatial audio signals; and wherein determining one of an active input spatial audio signal component and a passive audio signal input component includes determining based upon a mapping of the input signals onto the determined subspace of the codebook corresponding to the one or more direction vectors of the codebook.

Example 9 can include the subject matter of Example 1 wherein determining one of the active input spatial audio signal component and the passive audio signal input component, includes determining the active input spatial audio signal component; wherein determining the other of the active input spatial audio signal component and the passive input audio signal component based upon the determined one of the active input spatial audio signal component and the passive input audio signal component includes determining the passive input spatial audio signal component;

Example 10 can include the subject matter of Example 1 and further including: converting the one or more input spatial audio signals having the input spatial format from a time-domain representation to a time-frequency representation; and converting the first output signal having the first output format and the second output signal having the second output format from the time-frequency representation to the time-domain representation.

Example 11 can include the subject matter of Example 1 further including: combining the first output format and the second output signal having the second output format.

Example 12 can include the subject matter of Example 1 wherein at least one of the first spatial output format and the second spatial output format includes an ambisonic format.

Example 13 can include or use subject matter that includes an audio signal decoder comprising: a processor and a non-transitory computer readable medium operably coupled thereto, the non-transitory computer readable medium comprising a plurality of instructions stored in association therewith that are accessible to, and executable by, the processor, where the plurality of instructions comprises: instructions (302) that, when executed, receive in a time-frequency representation input spatial audio signals having an input spatial format; instructions (803) that, when executed, group the one or more received signals into one or more frequency bands; instructions, that when executed, for signals in each of the one or more frequency bands, determine (815) energy content of the signals within the frequency band; in response to a determination that the energy content of the signals within the frequency band does not meet a threshold, determine (817, 811) the signals within the frequency band as a passive input spatial audio signal; in response to a determination that the energy content of the signals within the frequency band does meet a threshold, determine (819, 821)) a number and directions of arrival of directional audio sources represented in of the signals within the frequency band; determine (823) one of an active input spatial audio signal component and a passive spatial audio signal input component, based upon the determined number and direction of arrival of the audio sources represented in the signals within the frequency band; determine (823) the other of the active input spatial audio signal component and the passive input spatial audio signal component, based upon the determined one of the active input spatial audio signal component and the passive input spatial audio signal component; instructions (308) that when executed, configure a decoder to decode for each of the one or more frequency bands, each determined active input spatial audio signal component having the input spatial format, to a first output signal having a first output format; instructions (310) that when executed, configure a decoder to decode for each of the one or more frequency bands, each determined passive input spatial audio signal component having the input spatial format, to a second output signal having second output format.

Example 14 can include the subject matter of Example 13 wherein the instructions, that when executed, for signals in each of the one more frequency bands, determine (815) whether signals within the frequency band are to be statically processed as passive components; and in response to a determination that the signals within the frequency band are to be statically processed as passive components, determine (811) the signals within the frequency band as a passive input spatial audio signal.

Example 15 can include or use subject matter that includes a method to decode audio signals comprising: receiving in a time-frequency representation input spatial audio signals having an input spatial format; grouping the one or more received signals into one or more frequency bands; in each of the one or more frequency bands, determining (815) energy content of the signals within the frequency band; in response to a determination that the energy content of the signals within the frequency band does not meet a threshold, determining (817, 811) the signals within the frequency band as a passive input spatial audio signal; in response to a determination that the energy content of the signals within the frequency band does meet a threshold, determining (819, 821)) a number and directions of arrival of directional audio sources represented in the signals within the frequency band; determining (823) one of an active input spatial audio signal component and a passive spatial audio signal input component, based upon the determined number and direction of arrival of the audio sources represented in the signals within the frequency band; determining (823) the other of the active input spatial audio signal component and the passive input spatial audio signal component, based upon the determined one of the active input spatial audio signal component and the passive input spatial audio signal component; configuring a decoder to decode for each of the one or more frequency bands, each determined active input spatial audio signal component having the input spatial format, to a first output signal having a first output format; configuring a decoder to decode for each of the one or more frequency bands, each determined passive input spatial audio signal component having the input spatial format, to a second output signal having a second output format.

Example 16 can include the subject matter of Example 15 further including: for signals in each of the one more frequency bands, determining (815) whether signals within the frequency band are to be statically processed as passive components; and in response to a determination that the signals within the frequency band are to be statically processed as passive components, determining (811) the signals within the frequency band as a passive input spatial audio signal.

Example 17 can include or use subject matter that includes an article of manufacture including a non-transitory machine-readable storage medium including instructions that; when executed by a machine, cause the machine to perform operations comprising: receiving in a time-frequency representation input spatial audio signals having an input spatial format; grouping the one or more received signals into one or more frequency bands; in each of the one or more frequency bands, determining (815) energy content of the signals within the frequency band; in response to a determination that the energy content of the signals within the frequency band does not meet a threshold, determining (817, 811) the signals within the frequency band as a passive input spatial audio signal; in response to a determination that the energy content of the signals within the frequency band does meet a threshold, determining (819, 821)) a number and directions of arrival of directional audio sources represented in the signals within the frequency band; determining (823) one of an active input spatial audio signal component and a passive spatial audio signal input component, based upon the determined number and direction of arrival of the audio sources represented in the signals within the frequency band; determining (823) the other of the active input spatial audio signal component and the passive input spatial audio signal component, based upon the determined one of the active input spatial audio signal component and the passive input spatial audio signal component; configuring a decoder to decode for each of the one or more frequency bands, each determined active input spatial audio signal component having the input spatial format, to a first output signal having a first output fauna; configuring a decoder to decode for each of the one or more frequency bands, each determined passive input spatial audio signal component having the input spatial format, to a second output signal having second output format.

Example 18 can include the subject matter of Example 17 further including: for signals in each of the one more frequency bands, determining (815) whether signals within the frequency band are to be statically processed as passive components; and in response to a determination that the signals within the frequency band are to be statically processed as passive components, determining (811) the signals within the frequency band as a passive input spatial audio signal.

Example 19 can include or use subject matter that includes a method of decoding a spatial audio signal (X) from an input spatial format [e.g., W, X, Y, Z] to an output spatial format [e.g., 5.1, 7.1, 11.1] comprising: receiving an input spatial audio signal (X) in an input spatial format [e.g., W, X, Y, Z]; and at each of one or more respective frequency bands, determining an active input signal subspace (G) within a respective frequency band (fb); deter mining an active output signal subspace (F) within the respective frequency band (fb); determining an active signal subspace projection ($(G^HG)^{-1}G^H$) to map the input spatial audio signal within the respective frequency band onto the determined active input signal subspace (G); determining active input spatial audio signal components (X,u) of the input spatial audio signal (X) at one or more frequency bins (b) within the respective frequency band (fb); determining passive input spatial audio signal components ($X_{PI}$), of the input spatial audio signal (X) at one or more frequency bins (b) within the respective frequency band (fb); configuring an active spatial audio signal decoder based upon the determined active signal subspace projection ($(G^HG)^{-1}G^H$) and the determined active output signal subspace (F); configuring a passive spatial audio signal decoder; using the active spatial audio signal decoder to decode the determined active input spatial audio signal components ($X_{AI}$) of the input spatial audio signal (X) to determine active output spatial audio signal components ($\vec{y}_A$) at one or more frequency bins (b) within the respective frequency band (fb); providing as an output signal, the determined active output spatial audio signal at one or more frequency bins (b) within the frequency band (fb); using the passive spatial audio signal decoder to decode the determined passive input spatial audio signal components ($X_{PI}$) of the input spatial audio signal (X) to determine passive output spatial audio signal components ($\vec{y}_P$) at the one or more frequency bins (b) within the respective frequency band (fb); providing as an output signal the determined passive output spatial audio signal components ($\vec{y}_P$) at one or more frequency bins (b) within the respective frequency band (fb), Example 20 can include the subject matter of Example 19 wherein the active input signal subspace (G) comprises one or more input spatial format steering vectors [$g_1$, $g_2$, . . . $g_p$] indicating directions of audio sources represented in the input spatial audio format [W, X, Y, Z] within the respective frequency band (fb); and wherein the active output signal subspace (Γ) comprises one or more output spatial format steering vectors [$f_1$, $f_2$, . . . $f_p$] indicating directions of audio sources represented in an output spatial audio format (e.g., 5.1, 7.1, 11.1) within the respective frequency band (fb).

Example 21 can include the subject matter of Example 19 wherein determining the active input spatial audio signal components ($X_{AI}$) includes determining based upon the determined active signal subspace projection ($(G^HG)^{-1}G^H$) within the respective frequency band (fb) and the input spatial audio signal (X) at the one or more frequency bins (b) within the frequency band (fb); and wherein determining the passive input spatial audio signal components ($X_{PI}$) includes determining based upon the input spatial audio signal (X) at the one or more frequency bins (b) within the respective frequency band (fb) and the determined active input spatial audio signal components ($X_{AI}$) at the one or more frequency bins (b) within the respective frequency band (fb).

Example 22 can include the subject matter of Example 19 wherein determining the active input spatial audio signal components ($X_{AI}$) includes determining based upon input spatial audio signal (X) at the one or more frequency bins (b) within the respective frequency band (fb) and the determined passive input spatial audio signal components ($X_{PI}$) at the one or more frequency bins (b) within the respective frequency band (fb); and wherein determining the passive input spatial audio signal components ($X_{PI}$) includes determining based upon the determined active signal subspace projection ($(G^HG)^{-1}G^H$) within the respective frequency band (fb) and the input spatial audio signal (X) at the one or more frequency bins (b) within the frequency band (fb).

Example 23 can include the subject matter of Example 19 wherein configuring the active spatial audio signal decoder includes determining a decoder matrix ($H_A$).

Example 24 can include the subject matter of Example 19 wherein configuring the active spatial audio signal decoder includes determining a decoder matrix ($H_A$) and smoothing the active decoder matrix over time.

Example 25 can include or use subject matter that includes an audio signal decoder for decoding a spatial audio signal (X) from an input spatial format [e.g., W, X, Y, Z] to an output spatial format [e.g., 5.1, 7.1, 11.1], comprising: a processor and a non-transitory computer readable medium operably coupled thereto, the non-transitory computer readable medium comprising a plurality of instructions stored in association therewith that are accessible to, and executable by, the processor, where the plurality of instructions comprises: instructions (302) that, when executed, receive an input spatial audio signal (X) in an input spatial format [e.g., W, X, Y, Z]; and instructions that, when executed, at each of one or more respective frequency bands, determine an active input signal subspace (G) within a respective frequency band (fb); determine an active output signal subspace (F) within the respective frequency band (fb); determine an active signal subspace projection ($(G^HG)^{-1}G^H$) to map the input spatial audio signal within the respective frequency band onto the determined active input signal subspace (G); determine active input spatial audio signal components ($X_{AI}$) of the input spatial audio signal (X) at one or more frequency bins (b) within the respective frequency band (fb); determine passive input spatial audio signal components ($X_{PI}$), of the input spatial audio signal (X) at one or more frequency bins (b) within the respective frequency band (fb); configure an active spatial audio signal decoder based upon the determined active signal subspace projection ($(G^HG)^{-1}G^H$) and the determined active output signal subspace (F); configure a passive spatial audio signal decoder; use the active spatial audio signal decoder to decode the determined active input spatial audio signal components ($X_{AI}$) of the input spatial audio signal (X) to determine active output spatial audio signal components ($\vec{y}_A$) at one or more frequency bins (b) within the respective frequency band (fb); provide as an output signal, the determined active output spatial audio signal at one or more frequency bins (b) within the frequency band (fb); use the passive spatial audio signal decoder to decode the determined passive input spatial audio signal components ($X_{PI}$) of the input spatial audio signal (X) to determine passive output spatial audio signal components ($\vec{y}_P$) at the one or more frequency bins (b) within the respective frequency band (fb); provide as an output signal the determined passive output spatial audio signal components ($\vec{y}_P$) at one or more frequency bins (b) within the respective frequency band (fb).

Example 26 can include the subject matter of Example 25 wherein the active input signal subspace (G) comprises one or more input spatial format steering vectors [$g_1$, $g_2$, . . . $g_p$] indicating directions of audio sources represented in the input spatial audio format [W, X, Y, Z] within the respective frequency band (fb); and wherein the active output signal subspace (Γ) comprises one or more output spatial format steering vectors [$f_1$, $f_2$, . . . $f_p$] indicating directions of audio sources represented in an output spatial audio format: (e.g., 5.1, 7.1, 1.1.1) within the respective frequency band (fb).

Example 27 can include the subject matter of Example 25 wherein the instructions that, when executed, determine the active input spatial audio signal components ($X_{AI}$), determine based upon the determined active signal subspace projection ($(G^HG)^{-1}G^H$) within the respective frequency band (fb) and the input spatial audio signal (X) at the one or more frequency bins (b) within the frequency band (fb); and wherein the instructions that, when executed, determine the passive input spatial audio signal components ($X_{PI}$), determine based upon the input spatial audio signal (X) at the one or more frequency bins (b) within the respective frequency band (fb) and the determined active input spatial audio signal components ($X_{AI}$) at the one or more frequency bins (b) within the respective frequency band (fb).

Example 28 can include the subject matter of Example 25 wherein the instructions that, when executed, determine the active input spatial audio signal components ($X_{AI}$), determine based upon the input spatial audio signal (X) at the one or more frequency bins (b) within the respective frequency band (fb) and the determined passive input spatial audio signal components ($X_{PI}$) at the one or more frequency bins (b) within the respective frequency band (fb); and wherein the instructions that, when executed, determine the passive input spatial audio signal components ($X_{PI}$), determine based upon the determined active signal subspace projection ($(G^HG)^{-1}G^H$) within. the respective frequency band (fb) and the input spatial audio signal (X) at the one or more frequency bins (b) within the frequency band (fb).

Example 29 can include the subject matter of Example 25 wherein configuring the active spatial audio signal decoder includes determining a decoder matrix ($H_A$).

Example 30 can include the subject matter of Example 25 wherein the instructions that, when executed, configure the active spatial audio signal decoder, determine a decoder matrix (HA) and smooth the active decoder matrix over time.

Example 31 can include or use subject matter that includes an article of manufacture including a non-transitory machine-readable storage medium including instructions that, when executed by a machine, cause the machine to perform a method of decoding a spatial audio signal (X) from an input spatial format [e.g., W, X, Y, Z] to an output spatial format [e.g., 5.1, 7.1, 11.1] comprising: receiving an input spatial audio signal (X) in an input spatial format [e.g., W, X, Y, Z]; and at each of one or more respective frequency bands, determining an active input signal subspace (G) within a respective frequency band (fb); determining an active output signal subspace (Γ) within the respective frequency band (fb); determining an active signal subspace projection ($(G^HG)^{-1}G^H$) to map the input spatial audio signal within the respective frequency band onto the determined active input signal subspace (G); determining active input spatial audio signal components ($X_{AI}$) of the input spatial audio signal (X) at one or more frequency bins (b) within the respective frequency band (fb); determining passive input spatial audio signal components ($X_{PI}$), of the input spatial audio signal (X) at one or more frequency bins (b) within the respective frequency band (fb); configuring an active spatial audio signal decoder based upon the deter mined active signal subspace projection ($(G^HG)^{-1}G^H$) and the determined active output signal subspace (Γ); configuring a passive spatial audio signal decoder; using the active spatial audio signal decoder to decode the determined active input spatial audio signal components ($X_{AI}$) of the input spatial audio signal (X) to determine active output spatial audio signal components ($\vec{y}_A$) at one or more frequency bins (b) within the respective frequency band (fb); providing as an output signal, the determined active output spatial audio signal at one or more frequency bins (b) within the frequency band (fb); using the passive spatial audio signal decoder to decode the determined passive input spatial audio signal components ($X_{PI}$) of the input spatial audio signal (X) to determine passive output spatial audio signal components ($\vec{y}_P$) at the one or more frequency bins (b) within the respective frequency band (fb); providing as an output signal the determined passive output spatial audio signal components ($\vec{y}_P$) at one or more frequency bins (b) within the respective frequency band (fb).

Example 32 can include the subject matter of Example 31 wherein the active input signal subspace (G) comprises one or more input spatial format steering vectors [$g_1$, $g_2$, . . . , $g_p$] indicating directions of audio sources represented in the input spatial audio format [W, X, Y, Z] within the respective frequency band (fb); and wherein the active output signal subspace (Γ) comprises one or more output spatial format steering vectors [$f_1$, $f_2$, . . . $f_p$] indicating directions of audio sources represented in an output spatial audio format (e.g., 5.1, 7.1, 11.1) within the respective frequency band (fb).

Example 33 can include the subject matter of Example 25 wherein Bete mining the active input spatial audio signal components ($X_{AI}$) includes determining based upon the determined active signal subspace projection ($(G^HG)^{-1}G^H$) within the respective frequency band (fb) and the input spatial audio signal (X) at the one or more frequency bins (b) within the frequency band (fb); and wherein determining the passive input spatial audio signal components ($X_{PI}$) includes Bete mining based upon the input spatial audio signal (X) at the one or more frequency bins (b) within the respective frequency band (fb) and the determined active input spatial audio signal components ($X_{AI}$) at the one or more frequency bins (b) within the respective frequency band (fb).

Example 34 can include the subject matter of Example 25 wherein determining the active input spatial audio signal components ($X_{AI}$) includes determining based upon input spatial audio signal (X) at the one or more frequency bins (b) within the respective frequency band (fb) and the determined passive input spatial audio signal components ($X_{PI}$) at the one or more frequency bins (b) within the respective frequency band (fb); and wherein determining the passive input spatial audio signal components ($X_{PI}$) includes determining based upon the determined active signal subspace projection ($(G^HG)^{-1}G^H$) within the respective frequency band (fb) and the input spatial audio signal (X) at the one or more frequency bins (b) within the frequency band (fb).

Example 35 can include the subject matter of Example 25 wherein configuring the active spatial audio signal decoder includes determining a decoder matrix ($H_A$).

Example 36 can include the subject matter of Example 25 wherein configuring the active spatial audio signal decoder includes determining a decoder matrix ($H_A$) and smoothing the active decoder matrix over time.

Example 37 can include or use subject matter that includes an audio signal decoder comprising: means for receiving one or more input spatial audio signals having an input spatial format; means for determining a number and direction of arrival of directional audio sources represented in the one or more input spatial audio signals having an input spatial format; means for determining one of an active input spatial audio signal component and a passive spatial audio signal input component, based upon the determined number and direction of arrival of the audio sources represented in the one or more input spatial audio signals; means for determining the other of the active input spatial audio signal component and the passive input spatial audio signal component, based upon the determined one of the active input spatial audio signal component and the passive input spatial audio signal component; means for decoding the active input spatial audio signal component having the input spatial format, to a first output signal having a first output format; means for decoding the passive input spatial audio signal component having the input spatial format, to a second output signal having a second output format.

Example 38 can include the subject matter of Example 37 wherein the first output format is different from the second output format.

Example 39 can include the subject matter of Example 37 wherein the first output format matches the second output format.

Example 40 can include the subject matter of Example 37 wherein the instructions that, when executed, determine the number and direction of arrival of directional audio sources, determine a subspace corresponding to one or more direction vectors of a codebook to represent the one or more input spatial audio signals.

Example 41 can include the subject matter of Example 37 wherein the instructions that, when executed, determine the number and direction of arrival of directional audio sources, determine a subspace corresponding to one or more direction vectors of a codebook to represent the input spatial audio signals, based upon an optimality metric computed for direction vectors within the codebook.

Example 42 can include the subject matter of Example 41 wherein the optimality metric includes one or more correlations between direction vectors within the codebook and one or more eigenvectors of a noise subspace of the input spatial audio signal.

Example 43 can include the subject matter of Example 41 wherein the optimality metric includes a correlation between direction vectors within the codebook and the input spatial audio signal.

Example 44 can include the subject matter of Example 37 wherein the instructions that, when executed, determine a number and directions of arrival of directional audio sources, determine a subspace corresponding to one or more direction vectors of a codebook to represent the input spatial audio signals; and wherein the instructions that, when executed, determine one of an active input spatial audio signal component and a passive audio signal input component, determine based upon a mapping of the input signal onto the determined subspace corresponding to the one or more direction vectors of the codebook.

Example 45 can include the subject matter of Example 37 wherein the instructions that, when executed, determine one of the active input spatial audio signal component and the passive audio signal input component, determine the active spatial audio signal component; wherein the instructions that when executed, determine the other of the active input spatial audio signal component and the passive audio signal component based upon the determined one of the active input spatial audio signal component and the passive audio signal component, determine the passive spatial audio signal component;

Example 46 can include the subject matter of Example 37 further including: means for converting the input spatial audio signals having the input spatial format from a time-domain representation to a time-frequency representation; and means for converting the first output signal having the first output format and the second output signal having the second output format from the time-frequency representation to the time-domain representation.

Example 47 can include the subject matter of Example 37 further including means for combining the first output signal having the first output format and the second output signal having the second output format.

Example 48 can include the subject matter of Example 37 wherein at least one of the first spatial output format and the second spatial output format includes an ambisonic format.

While the above detailed description has shown, described, and pointed out novel features as applied to various examples, it will be understood that various omissions, substitutions, and changes in the format and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

The invention claimed is:

1. An audio signal decoder comprising:

a processor and a non-transitory computer readable medium operably coupled thereto, the non-transitory computer readable medium comprising a plurality of instructions stored in association therewith that are accessible to, and executable by, the processor, where the plurality of instructions comprises:

instructions that, when executed, receive an input spatial audio signal having an input spatial format, the input spatial format comprising multiple channels, each channel having a corresponding directivity pattern, the input spatial audio signal comprising an active spatial audio signal component and a passive spatial audio signal component;

instructions that, when executed, determine a number of directional audio sources represented in the input spatial audio signal having the input spatial format and determine a direction of arrival for each of the determined number of directional audio sources represented in the input spatial audio signal having the input spatial format;

instructions that when executed, determine one of the active input spatial audio signal component and the passive input spatial audio signal component, based upon the number and directions of arrival of the directional audio sources represented in the input spatial audio signal;

instructions that when executed, determine the other of the active input spatial audio signal component and the passive input spatial audio signal component, based upon the one of the active input spatial audio signal component and the passive input spatial audio signal component;

instructions that when executed, decode the active input spatial audio signal component having the input spatial format, to a first output signal having a first output format;

instructions that when executed, decode the passive input spatial audio signal component having the input spatial format, to a second output signal having a second output format.

2. The audio signal decoder of claim 1, wherein the first output format is different from the second output format.

3. The audio signal decoder of claim 1, wherein the first output format matches the second output format.

4. The audio signal decoder of claim 1, wherein the instructions that, when executed, determine the number of directional audio sources and the direction of arrival for each of the determined number of directional audio sources, determine a subspace corresponding to one or more direction vectors of a codebook to represent the input spatial audio signal.

5. The audio signal decoder of claim 1, wherein the instructions that, when executed, determine the number of directional audio sources and the direction of arrival for each of the determined number of directional audio sources, determine a subspace corresponding to one or more direction vectors of a codebook to represent the input spatial audio signal, based upon an optimality metric computed for direction vectors within the codebook.

6. The audio signal decoder of claim 5, wherein the optimality metric includes one or more correlations between direction vectors within the codebook and one or more eigenvectors of a noise subspace of the input spatial audio signal.

7. The audio signal decoder of claim 5, wherein the optimality metric includes a correlation between direction vectors within the codebook and the input spatial audio signal.

8. The audio signal decoder of claim 1, wherein the instructions that, when executed, determine the number of directional audio sources and the direction of arrival for each of the determined number of directional audio sources, determine a subspace corresponding to one or more direction vectors of a codebook to represent the input spatial audio signal; and wherein the instructions that, when executed, determine one of an active input spatial audio signal component and a passive audio signal input component, determine based upon a mapping of the input signal onto the determined subspace corresponding to the one or more direction vectors of the codebook.

9. The audio signal decoder of claim 1, wherein the instructions that, when executed, determine one of the active input spatial audio signal component and the passive input spatial audio signal component, determine the active input spatial audio signal component;

wherein the instructions that when executed, determine the other of the active input spatial audio signal component and the passive input spatial audio signal component based upon the determined one of the active input spatial audio signal component and the passive input spatial audio signal component, determine the passive input spatial audio signal component.

10. The audio signal decoder of claim 1 further including:

instructions that, when executed, convert the input spatial audio signals having the input spatial format from a time-domain representation to a time-frequency representation; and instructions that, when executed, convert the first output signal having the first output format and the second output signal having the second output format from the time-frequency representation to the time-domain representation.

11. The audio signal decoder of claim 1 further including:

instructions that, when executed, combine the first output signal having the first output format and the second output signal having the second output format.

12. The audio signal decoder of claim 1, wherein at least one of the first output format and the second output format includes an ambisonic format.

13. A method to decode audio signals comprising:

receiving an input spatial audio signal in an input spatial format, the input spatial format comprising multiple channels, each channel having a corresponding directivity pattern, the input spatial audio signal comprising an active spatial audio signal component and a passive spatial audio signal component;

determining a number of directional audio sources represented in the input spatial audio signal having the input spatial format and determine a direction of arrival for each of the determined number of direction audio sources represented in the input spatial audio signal having the input spatial format;

determining one of an active input spatial audio signal component and the passive spatial audio signal input component, based upon the determined number and directions of arrival of the directional audio sources represented in the input spatial audio signal;

determining the other of the active input spatial audio signal component and the passive input spatial audio signal component, based upon the determined one of the active input spatial audio signal component and the passive input spatial audio signal component;

decoding the active input spatial audio signal component having the input spatial format, to a first output signal having a first output format;

decoding the passive input spatial audio signal component having the input spatial format, to a second output signal having second output format.

14. The method of claim 13, wherein the first output format is different from the second output format.

15. The method of claim 13, wherein the first output format matches the second output format.

16. The method of claim 13, wherein determining the number of directional audio sources and the direction of arrival for each of the determined number of directional audio sources, includes determining a subspace of a codebook to represent the input spatial audio signal.

17. The method of claim 13, wherein determining the number of directional audio sources and the direction of arrival for each of the determined number of directional audio sources, includes determining a subspace of a codebook corresponding to one or more direction vectors of the codebook to represent the input spatial audio signals, based upon an optimality metric computed for direction vectors within the codebook.

18. The method of claim 17, wherein the optimality metric includes one or more correlations between direction vectors within the codebook and one or more eigenvectors of a noise subspace of the input spatial audio signal.

19. The method of claim 17, wherein the optimality metric includes a correlation between direction vectors within the codebook and the input spatial audio signal.

20. The method of claim 13, wherein determining the number of directional audio sources and the direction of arrival for each of the determined number of directional audio sources, includes determining a subspace of a codebook corresponding to one or more direction vectors of the codebook to represent the input spatial audio signal; and wherein determining one of an active input spatial audio signal component and a passive audio signal input component, includes determining based upon a mapping of the spatial audio input signal onto the determined subspace of the codebook corresponding to the one or more direction vectors of the codebook.

21. The method of claim 13, wherein determining one of the active input spatial audio signal component and the passive audio signal input component, includes determining the active spatial audio signal component;

wherein determining the other of the active input spatial audio signal component and the passive audio signal component based upon the determined one of the active input spatial audio signal component and the passive audio signal component.

22. The method of claim 13, further including:

converting the one or more input spatial audio signals having the input spatial format from a time-domain representation to a time-frequency representation; and converting the first output signal having the first output format and the second output signal having the second output format from the time-frequency representation to the time-domain representation.

23. The method of claim 13, further including:

combining the first output signal having the first output format and the second output signal having the second output format.

24. The method of claim 13, wherein at least one of the first output format and the second output format includes an ambisonic format.

25. The audio signal decoder of claim 1, wherein at least of the first output format and the second output format comprises a spatial format.

26. The audio signal decoder of claim 13, wherein at least of the first output format and the second output format comprises a spatial format.

27. The audio signal decoder of claim 1, wherein the input spatial format comprises an ambisonic format.

28. The audio signal decoder of claim 13, wherein the input spatial format comprises an ambisonic format.

29. The method of claim 1, wherein the multiple directivity pattern components include at least one of an ambisonic W, X, Y or Z component.

30. The method of claim 13, wherein the multiple directivity pattern components include at least one of an ambisonic W, X, Y or Z component.

* * * * *